US008088986B2

(12) United States Patent
Takehisa

(10) Patent No.: US 8,088,986 B2
(45) Date of Patent: Jan. 3, 2012

(54) ELECTRONIC PERCUSSION INSTRUMENT PRESENTING PAD CHAIN PERFORMANCE

(75) Inventor: Hideaki Takehisa, Shizuoka-ken (JP)

(73) Assignee: Yamaha Corporation (JP)

( * ) Notice: Subject to any disclaimer, the term of this patent is extended or adjusted under 35 U.S.C. 154(b) by 140 days.

(21) Appl. No.: 12/558,098

(22) Filed: Sep. 11, 2009

(65) Prior Publication Data

US 2010/0064881 A1 Mar. 18, 2010

(30) Foreign Application Priority Data

Sep. 12, 2008 (JP) ..... 2008-234589

(51) Int. Cl.
*A63H 5/00* (2006.01)
*G10H 3/00* (2006.01)

(52) U.S. Cl. ..... 84/609; 84/411 R; 84/411 P; 84/622; 84/644; 84/735; 84/743

(58) Field of Classification Search ..... 84/609
See application file for complete search history.

(56) References Cited

U.S. PATENT DOCUMENTS 4,467,690 A * 8/1984 Nishimoto ..... 84/635
4,713,996 A * 12/1987 Oguri ..... 84/635
4,882,964 A * 11/1989 Okamoto et al. ..... 84/611
5,138,928 A * 8/1992 Nakajima et al. ..... 84/635
5,223,655 A 6/1993 Watanabe et al.
5,399,801 A * 3/1995 Hasebe et al. ..... 84/622
6,075,197 A 6/2000 Chan
7,078,610 B2 7/2006 Mori et al.
7,112,739 B2 9/2006 Mori et al.
7,381,885 B2 * 6/2008 Arimoto ..... 84/737
2008/0163739 A1 * 7/2008 Mori ..... 84/421
2010/0064880 A1 3/2010 Takehisa et al.

FOREIGN PATENT DOCUMENTS

JP 8-185170 A 7/1996
JP 2002182643 A 6/2002

* cited by examiner

*Primary Examiner* — Elvin G Enad
*Assistant Examiner* — Christopher Uhlir
(74) *Attorney, Agent, or Firm* — Rossi, Kimms & McDowell LLP

(57) ABSTRACT

An electronic percussion musical instrument comprises a plurality of playing pads for playing music by striking the face of each pad. The pads are configured to provide ungrouped pad zones, each constituted by an individual playing pad and grouped pad zones, each constituted by combining plural playing pads into a grouped pad zone to work as an integral pad zone. Timbres of musical tones are allocated to the respective pad zones. A sequence of pad zones, each designating the allocated timbre, is set for a pad zone to represent a pad chain performance, so that plural music playing strikes on the same pad zone cause the generation of musical tones in the timbres allocated not only to the struck pad zone but also to the other pad zones in the order designated in the sequence for the pad chain performance on the struck pad zone.

9 Claims, 16 Drawing Sheets

Hardware Configuration of Electronic Percussion Instrument

Fig. 5

Displayed Screen for Control Setting

35

| # | Pad Name | Group Setting | Tone Data | Mute Instruction | Choke Instruction | Pad Chain | |
|---|---|---|---|---|---|---|---|
| | | | | | | User Setting | Factory Setting |
| 1 | HHU | 1 | Timbre A | 7 | 7 | 1-2-3 | 1-2-3-4-5-6 |
| 2 | HNU | 2 | Timbre B - Timbre M | | | 2-3-1 | 2-3-4-5-6-1 |
| 3 | HMU | 3 | Timbre C | | | 3-1-2 | 3-4-5-6-1-2 |
| 4 | HHS | 4 | Timbre D | 1 | 1 | 4-4-5 | 4-5-6-1-2-3 |
| 5 | HNS | 5 | Timbre E | 2 | | 5 | 5-6-1-2-3-4 |
| 6 | HMS | 6 | Timbre F | 3 | 2 | 6 | 6-1-2-3-4-5 |
| 7 | RHU | 7 | Timbre G | | | 7 | 7-8-9-10-11-12 |
| 8 | RNU | 8 | Timbre H - Timbre N | | | 8 | 8-9-10-11-12-7 |
| 9 | RMU | 9 | Timbre I | | | 9 | 9-10-11-12-7-8 |
| 10 | RHS | 10 | Timbre J | 4 | 4 | 10 | 10-11-12-7-8-9 |
| 11 | RNS | 11 | Timbre K | | | 11 | 11-12-7-8-9-10 |
| 12 | RMS | 12 | Timbre L - Timbre O | 3 | | 12 | 12-7-8-9-10-11 |

S

Fig.6a
| | | |
|---|---|---|
| 7.RHU | 8.RNU | 9.RMU |
| 1.HHU | 2.HNU | 3.HMU |
| 4.HHS | 5.HNS | 6.HMS |
| 10.RHS | 11.RNS | 12.RMS |
Fig.6b
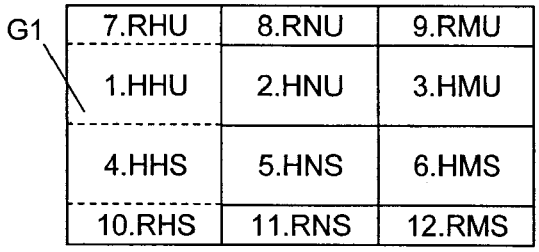
Fig.6c
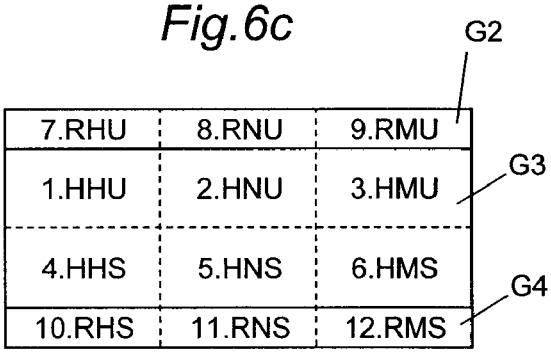
Fig.6d
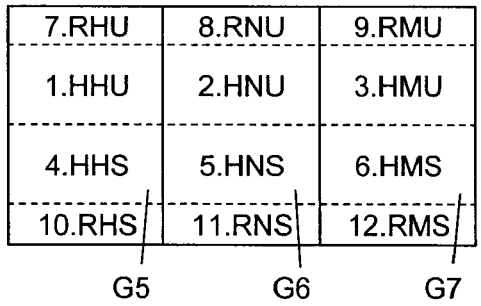
Fig.6e
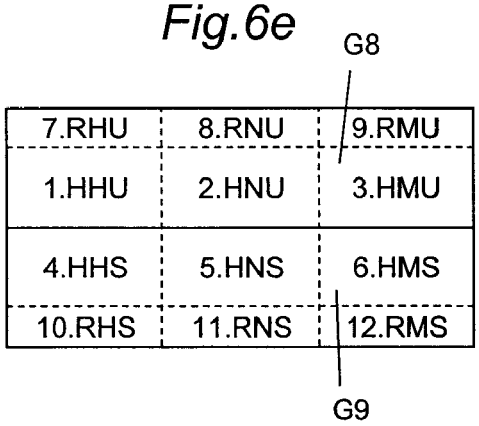
Fig.6f
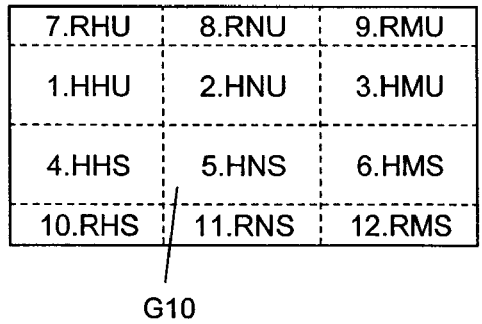

*Fig. 7*

*Displayed Screen for Control Setting*

| | |
|---|---|
| Pad Chain Setting | ■Off □User Setting □Factory Setting |
| Group Setting | □Off ■User Setting □Factory Setting A □Factory Setting B |
| Playing Technique Mode When Group Is Set | ■Mode A □Mode B |

Fig. 8

Displayed Screen for Control Setting

35

| # | Pad Name | Group Setting | Tone Data | Mute Instruction | Choke Instruction | Pad Chain | |
|---|---|---|---|---|---|---|---|
| | | | | | | User Setting | Factory Setting |
| 1 | HHU | G3 | Timbre A | 7 | 7 | G3→G2→G4 | G3→G2→G4 |
| 2 | HNU | | | | | | |
| 3 | HMU | | | 3, 6 | | | |
| 4 | HHS | | | 1 | 1 | | |
| 5 | HNS | | | 2 | | | |
| 6 | HMS | | | 3, 6 | 2 | | |
| 7 | RHU | G2 | Timbre G | | | G2→G4→G3 | G2→G4→G3 |
| 8 | RNU | | | | | | |
| 9 | RMU | | | | | | |
| 10 | RHS | G4 | Timbre G | 4 | 4 | G4→G3→G2 | G4→G3→G2 |
| 11 | RNS | | | | | | |
| 12 | RMS | | | 3 | | | |

S

Main Routine

*Processing for Accepting Control Setting Manipulation*

*Processing for Accepting Control Setting Manipulation*

*Processing for Accepting Music Playing Manipulation for Individual or Grouped Pad*

*Processing for Accepting Music Playing Manipulation under Mute Instruction*

*Processing for Accepting Music Playing Manipulation under Choke Instruction*

*Processing for Accepting Music Playing Manipulation for Pad Chain*

ELECTRONIC PERCUSSION INSTRUMENT PRESENTING PAD CHAIN PERFORMANCE

BACKGROUND OF THE INVENTION

The present invention relates to an electronic percussion musical instrument which has striking pads (i.e. music playing pads) and generates percussion musical tones when the pads are struck by the player, and more particularly to such an instrument in which timbres of musical tones are allocated to the striking pads, respectively. For a striking pad, a sequence of different timbres aligned in an order are set to present a pad chain performance in which plural strikes in succession onto the same striking pad will cause the generation of musical tones in the timbres as designated by the sequence and in the order of timbre in the sequence.

Known in the art are such electronic percussion musical instruments which have music playing manipulation elements in the form of a pad (i.e. playing pads) to be struck by the player and generate electronic musical tones resembling drum sounds and cymbal sounds when the pads are struck, such as disclosed in registered Japanese patent publications No. 3,835,163 and No. 3,554,770. Such electronic percussion instruments having pad-type music playing manipulation elements are capable of generating individual musical tones or a short phrase of musical tones when the pads are struck by the sticks or hands or other body parts.

Such known electronic percussion instruments are provided with a plurality of playing pads. Mostly in such an electronic percussion instrument, only one timbre of musical tone is allocated to each of the playing pads. However there some electronic percussion instruments in which several timbres of musical tones are allocated to at least one of the playing pads, and successive strikes onto the same playing pad will cause the generation of musical tones in such allocated timbres in turns in a predetermined order. With such an electronic percussion instrument, when one pad is struck in succession, a different tone will be produced for every strike, and a wide variety of percussion instrument performance will be realized with an enhanced musical expression. In a conventional instrument of such a type, however, only those musical tones that are allocated to the struck pad can be generated, even though a plural timbres are allocated to one pad, and consequently the successive strikes onto one pad cannot permit the generation of tones in the timbre which is allocated to another pad (and not to the struck pad) to realize the tone generation in a wide range of timbres.

SUMMARY OF THE INVENTION

In view of the foregoing circumstances, therefore, it is a primary object of the present invention to provide an electronic percussion musical instrument having a plurality of music playing manipulation elements such as playing pads, in which various timbres are allocated to the respective playing pads and successive strikes onto one pad can generate different timbres including not only those allocated to the struck pad but also those allocated to another pad, thereby realizing a variety of musical expressions in response to the successive strikes.

According to the present invention, the object is accomplished by providing an electronic percussion musical instrument comprising: a music playing manipulation unit including a plurality of playing pads, each constituting a manipulating face zone for playing music by manipulating the face zone, the playing pads being capable of providing an ungrouped pad zone constituted by an individual playing pad among the plurality of playing pads and a grouped pad zone constituted by combining at least two of the playing pads among the plurality of playing pads into a grouped pad zone to work as an integral pad zone; a storage unit that stores plural timbres of musical tones; a musical tone allocating unit that allocates the musical tones stored in the storage unit to the ungrouped and/or grouped pad zones in predetermined correspondence; a music playing manipulation detecting unit that detects a music playing manipulation performed onto any of the pad zones; a musical tone generating unit that generates a musical tone allocated to the pad zone onto which the music playing manipulation is detected; and a pad chain setting unit that sets for a pad zone to be manipulated a sequence of designations of at least two different pad zones including a first pad zone and a second pad zone; wherein, when a first pad zone is manipulated for playing music one after another, the musical tone generating unit generates a first musical tone allocated to the first pad zone designated by the sequence in response to a playing manipulation onto the first pad zone, and a second musical tone allocated to the second pad zone designated by the sequence other than the first pad zone in response to another playing manipulation onto the first pad zone.

According to the present invention, successive playing manipulations performed onto the same pad zone (ungrouped or grouped) will cause the generation of a tone in the timbre allocated to the performed pad zone in response to one of the playing manipulations and cause the generation of a tone in another timbre which is allocated to another pad zone other than the performed pad zone in response to another of the playing manipulations, which enables the generation of tones in varying timbres from among a variety of timbres including the timbres allocated to other pad zones. This will help in diversifying musical expressions in response to the playing manipulations. Further, as the pad zones may be grouped pad zones as well as ungrouped pad zones, and accordingly the successive manipulations may be onto an ungrouped pad zone and also on to a grouped pad zone in order to generate the tones of the timbre allocated to another ungrouped or grouped pad zone. Thus, both the ungrouped pad zones and the grouped pad zones will be utilized effectively, and thus the musical performances on the electronic percussion instrument will be abundant in musical expressions.

In an aspect of the present invention, a number of musical tones may be allocated to a number of pad zones, respectively, and when a plurality of music playing manipulations are performed one after another onto the first pad zone for which the sequence is set, the musical tone generating unit may generate the musical tones respectively allocated to the pad zones in an order designated by the sequence set for the first pad zone in response to the playing manipulations onto the first pad zone. According to this configuration, the successive playing manipulations onto one pad zone will cause the generation of the tones in the timbres allocated to other manipulating pad zones in a predetermined order, which will add some regularity in the tones generated in response to the manipulations onto one pad zone.

In another aspect of the present invention, if a third pad zone other than the first pad zone for which the sequence is set is manipulated after a manipulation onto the first pad zone and then the first pad zone is manipulated again, the musical tone generating unit may generate a musical tone allocated to the third pad zone and then generate the musical tone allocated to the pad zone which is designated next to the pad zone of which the allocated musical tone was generated before the musical tone allocated to the third pad zone is generated according to the sequence, or the musical tone generating unit may generate a musical tone allocated to the third pad zone and then generate the musical tone allocated to the pad zone which is designated first in the sequence, resetting the sequence running. According to this configuration, the generated tones will have some regularity as well as some variety.

In a further aspect of the present invention, the storage unit may store a first kind of information concerning the allocation of the musical tones to the pad zones and a second kind of information concerning the sequence of designations, the musical tone allocating unit may allocate the musical tones to the pad zones based on the first kind of information, and the pad chain setting unit may set the sequence of designations based on the second kind of information. This will facilitate the user's operation for setting the timbres of the tones to be generated in response to manipulations on one pad zones, and the maneuverability of the electronic percussion instrument will be enhanced.

In a still further aspect of the present invention, the electronic percussion musical instrument may further comprise: a playing technique effect imparting unit that imparts an effect of special playing technique to the musical tone to be generated in response to a music playing manipulation on the pad zone; and a playing technique instruction pad zone setting unit that sets a pad zone among the pad zones to work as a playing technique instruction inputting pad zone for inputting an instruction from a player to effect a special playing technique, the playing technique instruction inputting pad zone being determined in association with the pad zone allocated for generating the musical tone to which the effect of the special playing technique is to be imparted. By determining the playing technique instruction inputting pad zone in association with the pad zone allocated for generating the musical tone to which the effect of the special playing technique is to be imparted, the manipulation for imparting the effect of the special playing technique will be easy, and the music expressions by the electronic percussion instrument will be greatly enhanced.

In a still further aspect of the present invention, the pad zone for playing music and the pad zone for inputting the playing technique instruction may be both the grouped pad zones. According to this configuration, an effect of a special playing technique can be imparted to the tone generated in response to the manipulation onto the grouped pad zone, and the manipulation for instructing an effect of a special playing technique will be easily operated. Thus the music expressions by the electronic percussion instrument will be further enhanced.

In a still further aspect of the present invention, the playing technique instruction pad zone setting unit may set a single ungrouped pad zone or a grouped pad zone in common for inputting instructions for plural kinds of special playing technique effects. According to this configuration, the operation for setting a pad zone for inputting instructions for special playing technique effects and the operation for inputting instructions for special playing technique effects will be easily carried out. Thus the maneuverability for playing music and for setting various items will be greatly enhanced.

With an electronic percussion instrument according to the present invention, the musical tones having different timbres which are allocated to other different pad zones can be generated one after another in response to successive manipulations onto the same pad zone for playing music. This will ensure a variety in the musical performances on the electronic percussion instrument.

The invention and its various embodiments can now be better understood by turning to the following detailed description of the preferred embodiments which are presented as illustrated examples of the invention defined in the claims. It is expressly understood that the invention as is defined by the claims may be broader than the illustrated embodiments described bellow.

BRIEF DESCRIPTION OF THE DRAWINGS

For a better understanding of the present invention, and to show how the same may be practiced and will work, reference will now be made, by way of example, to the accompanying drawings, in which:

1.

Figure 1:
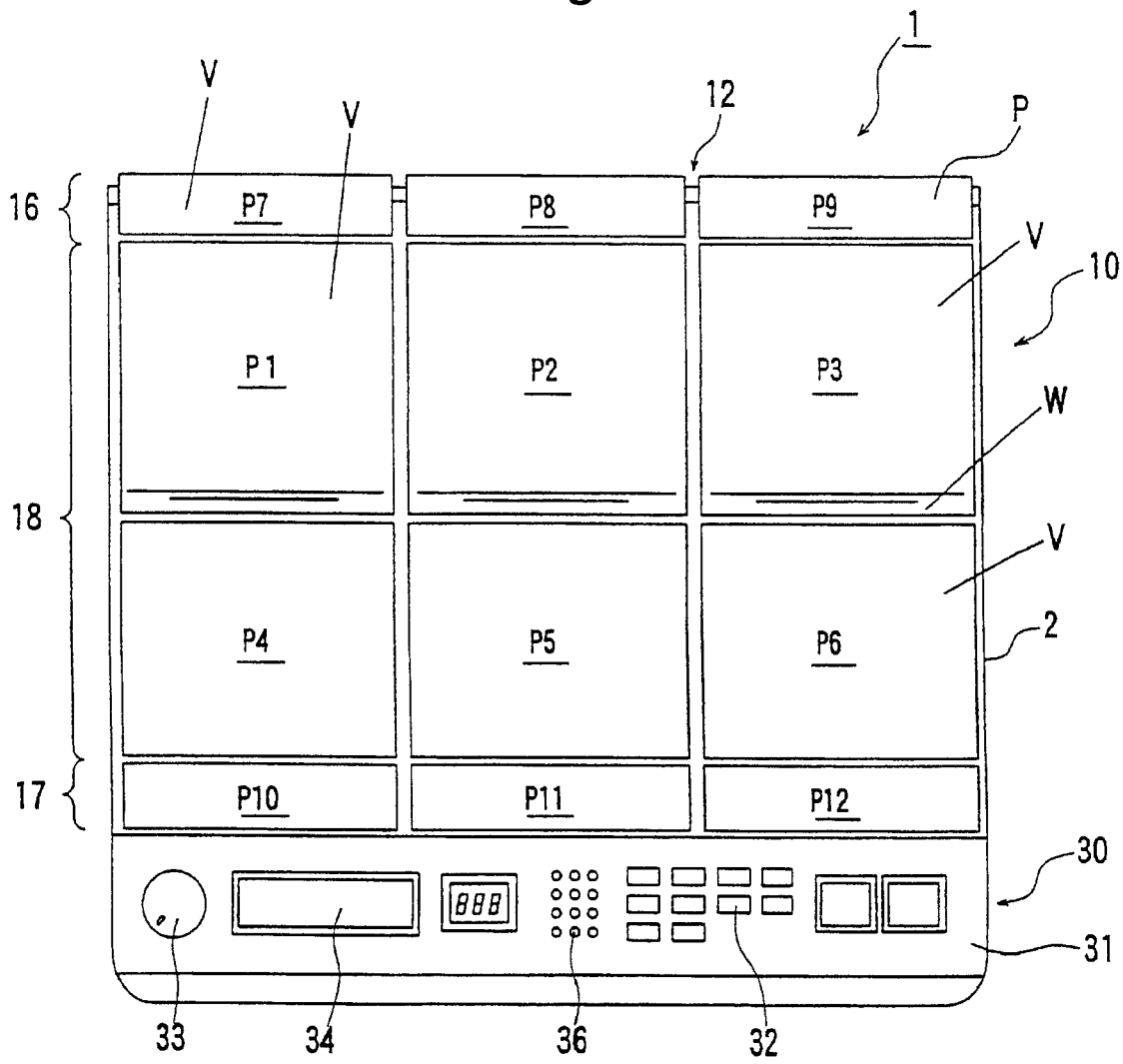
Figure 2A:
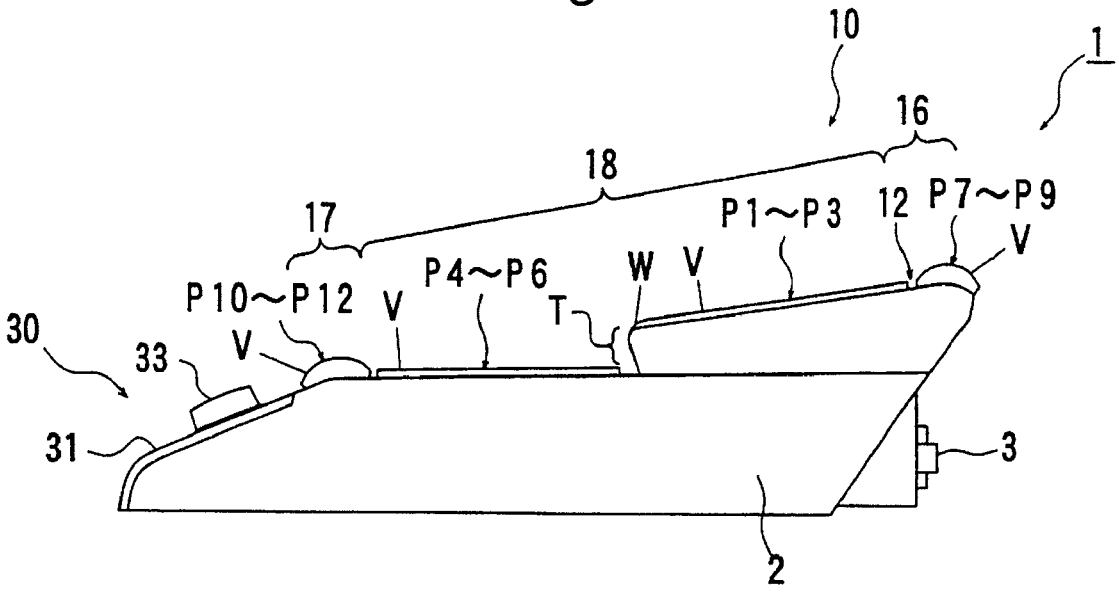
Figure 2B:
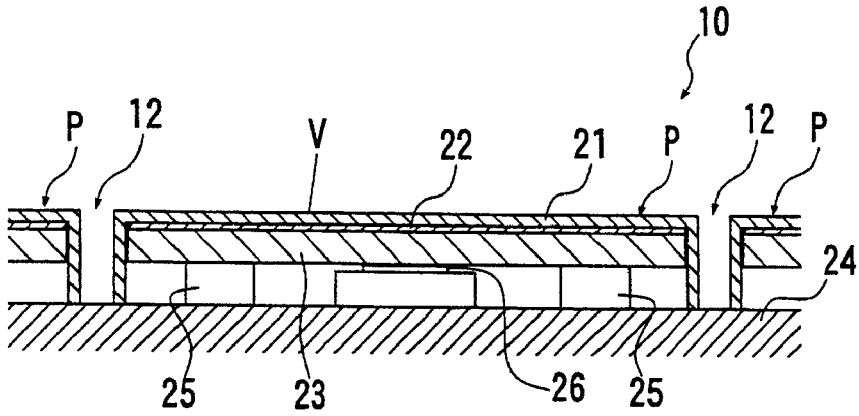

FIG. 1 is a plan view showing an electronic percussion instrument according to an embodiment of the present invention;

FIG. 2*a* is a side elevational view showing the electronic percussion instrument of FIG. 1;

FIG. 2*b* is a cross-sectional front view showing an outline of the pads included in the embodiment of FIG. 2*a;*

Figure 3:
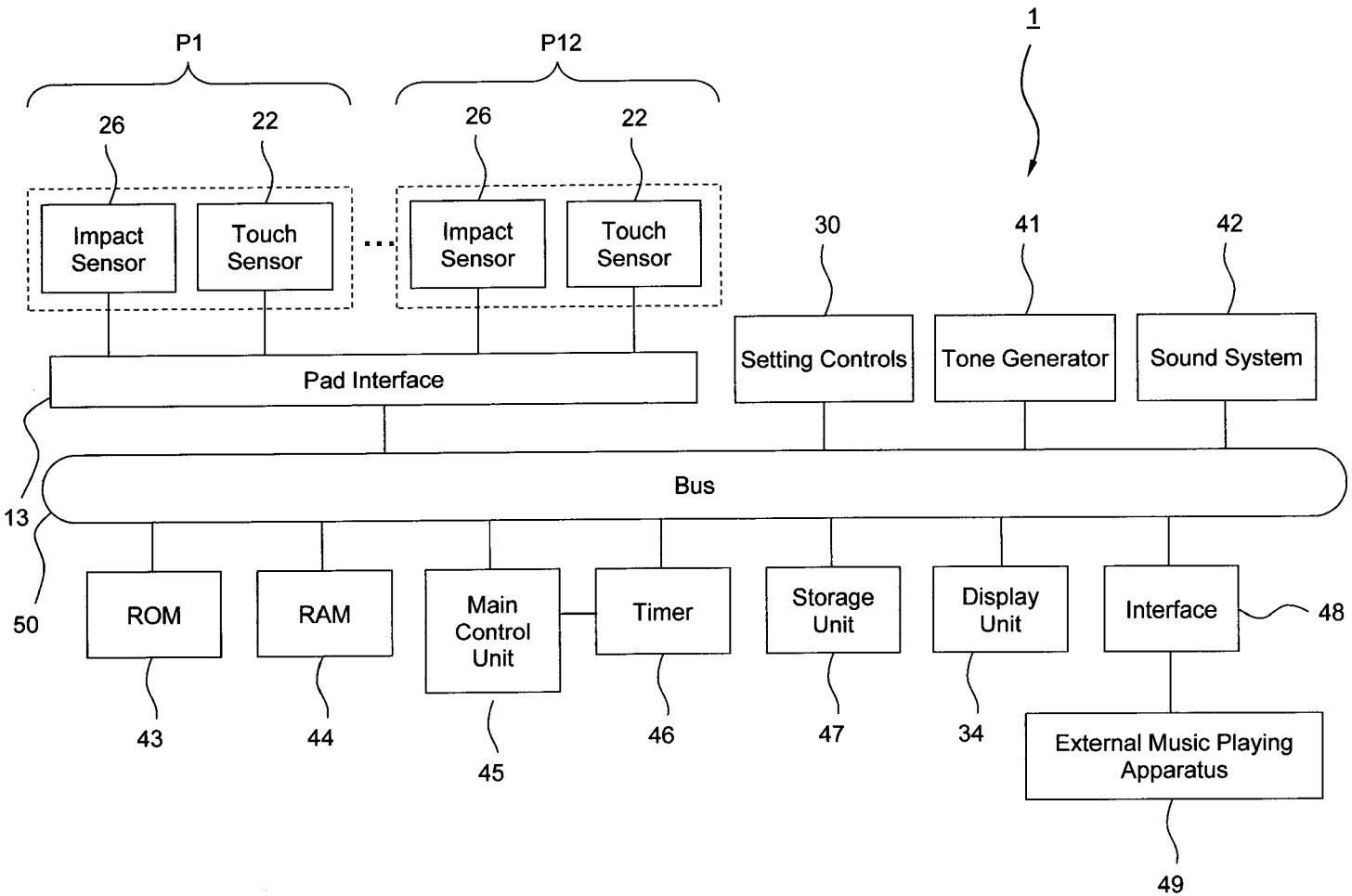
Figure 4:
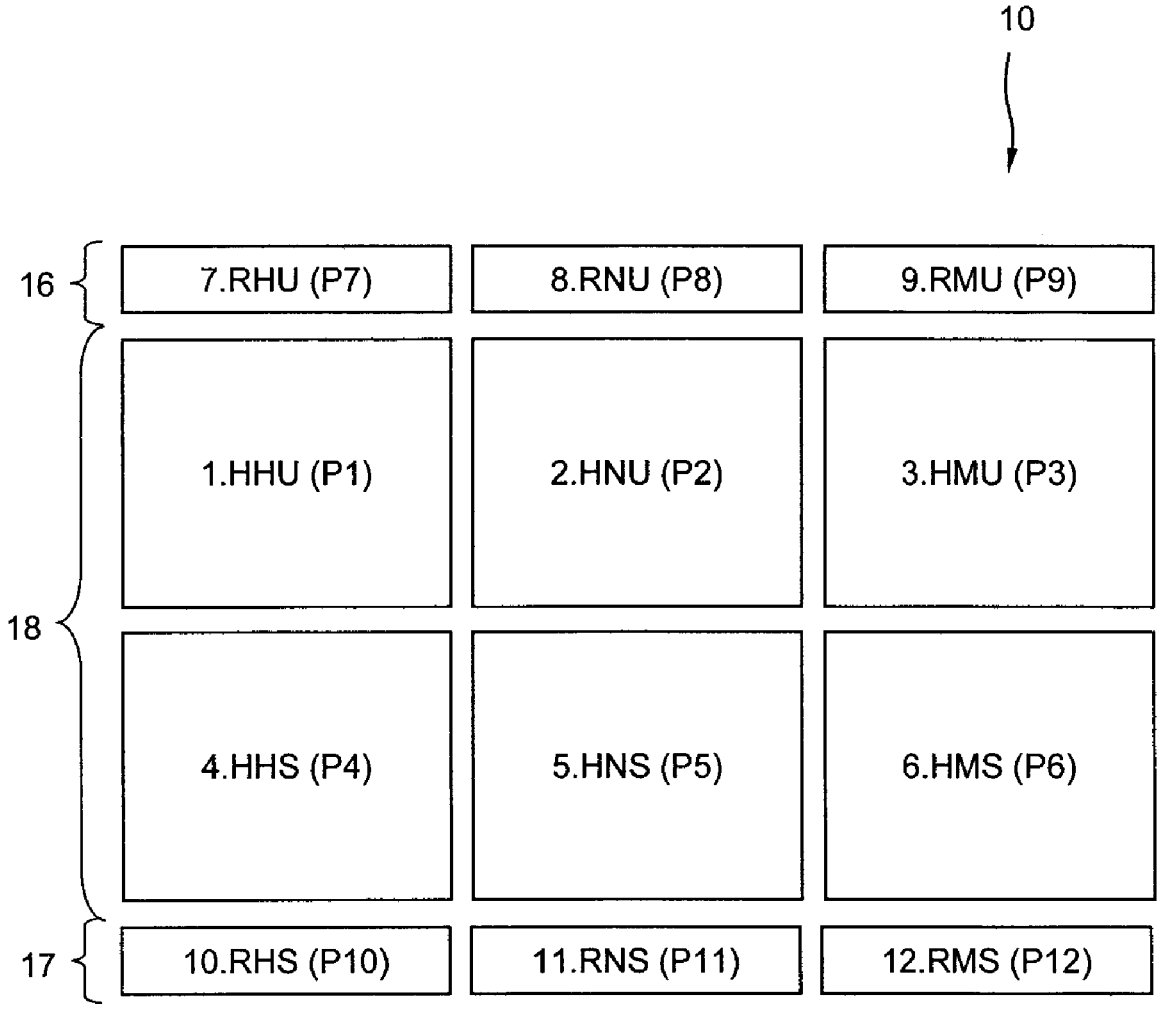
Figure 9:
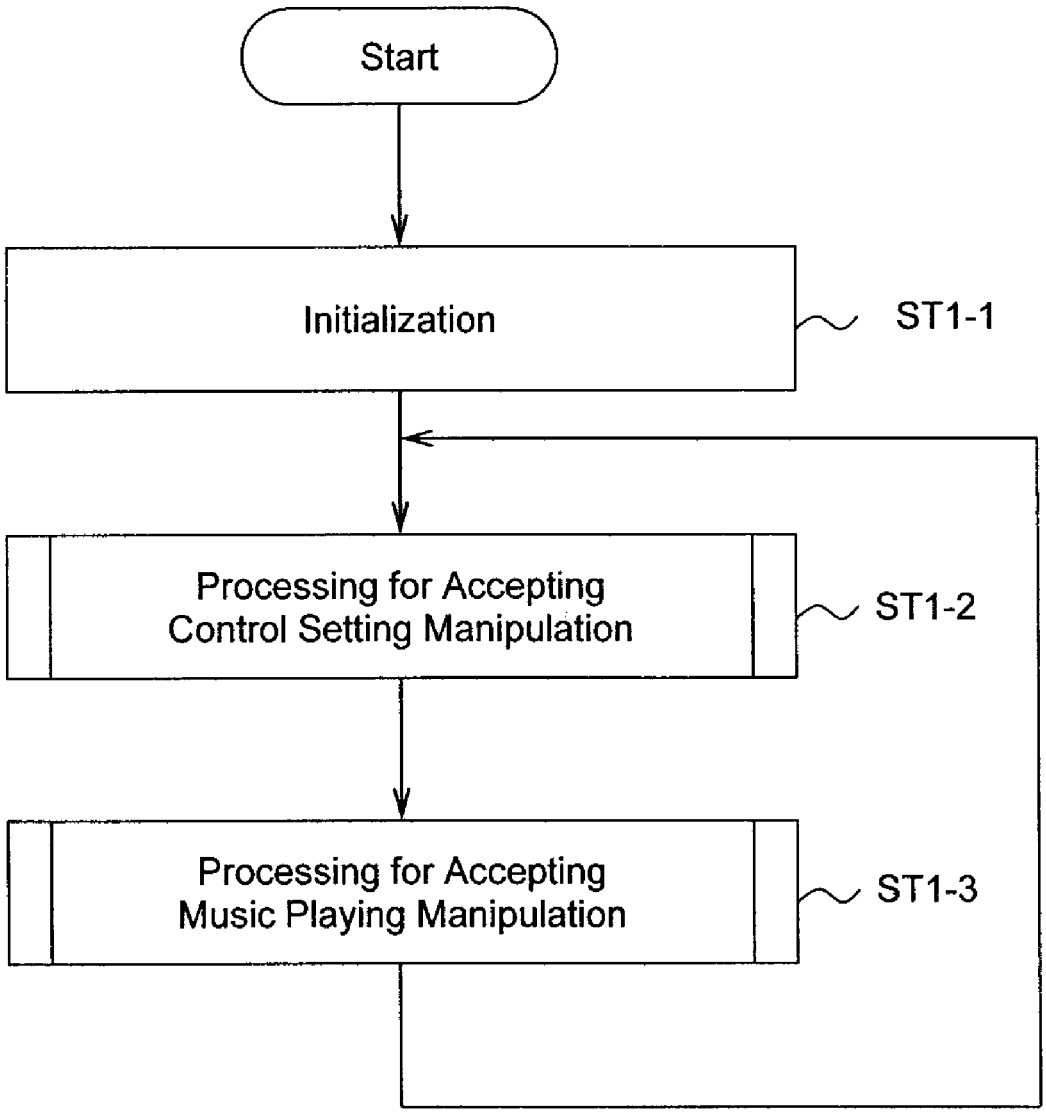
Figure 10A:
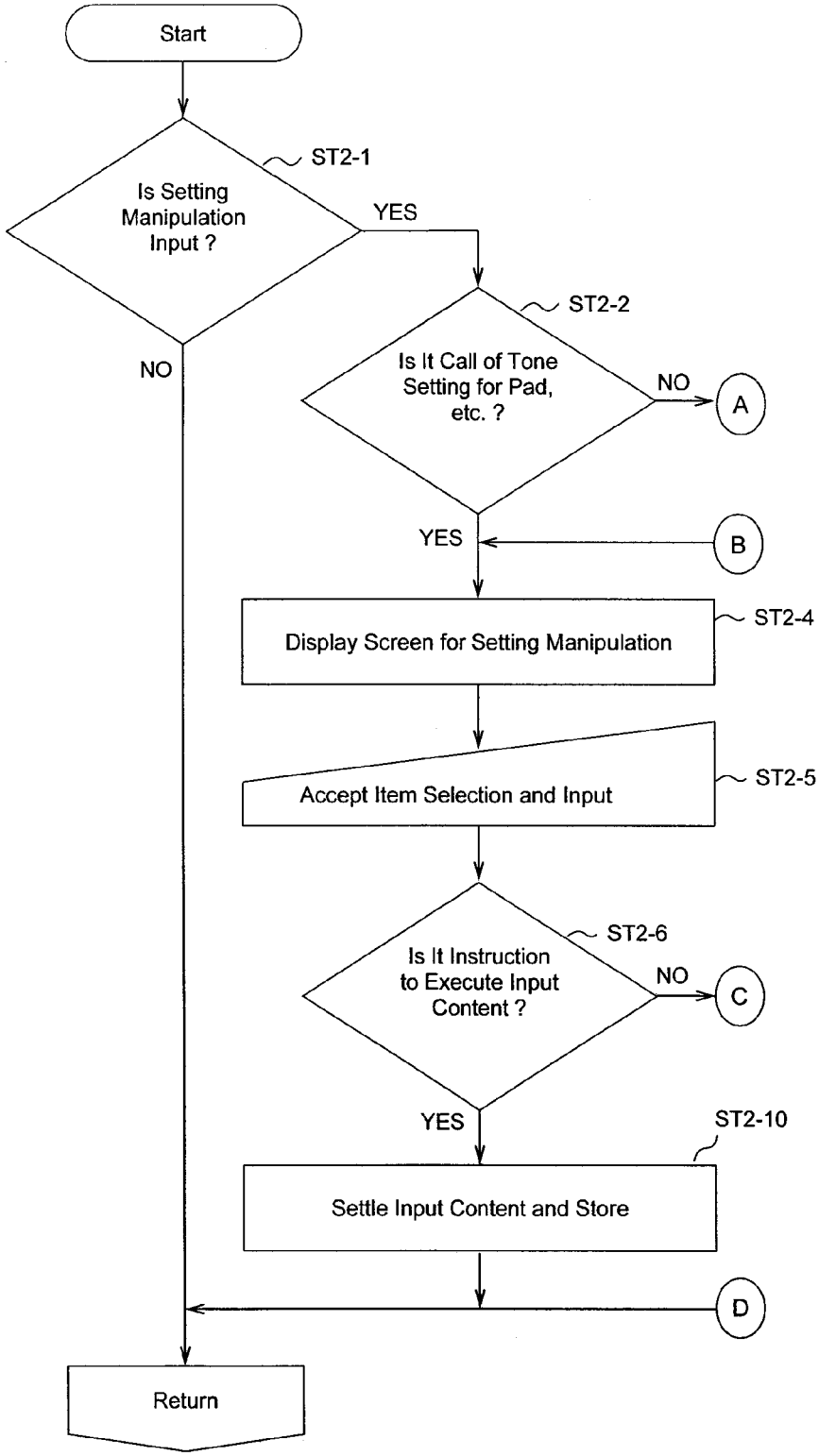
Figure 10B:
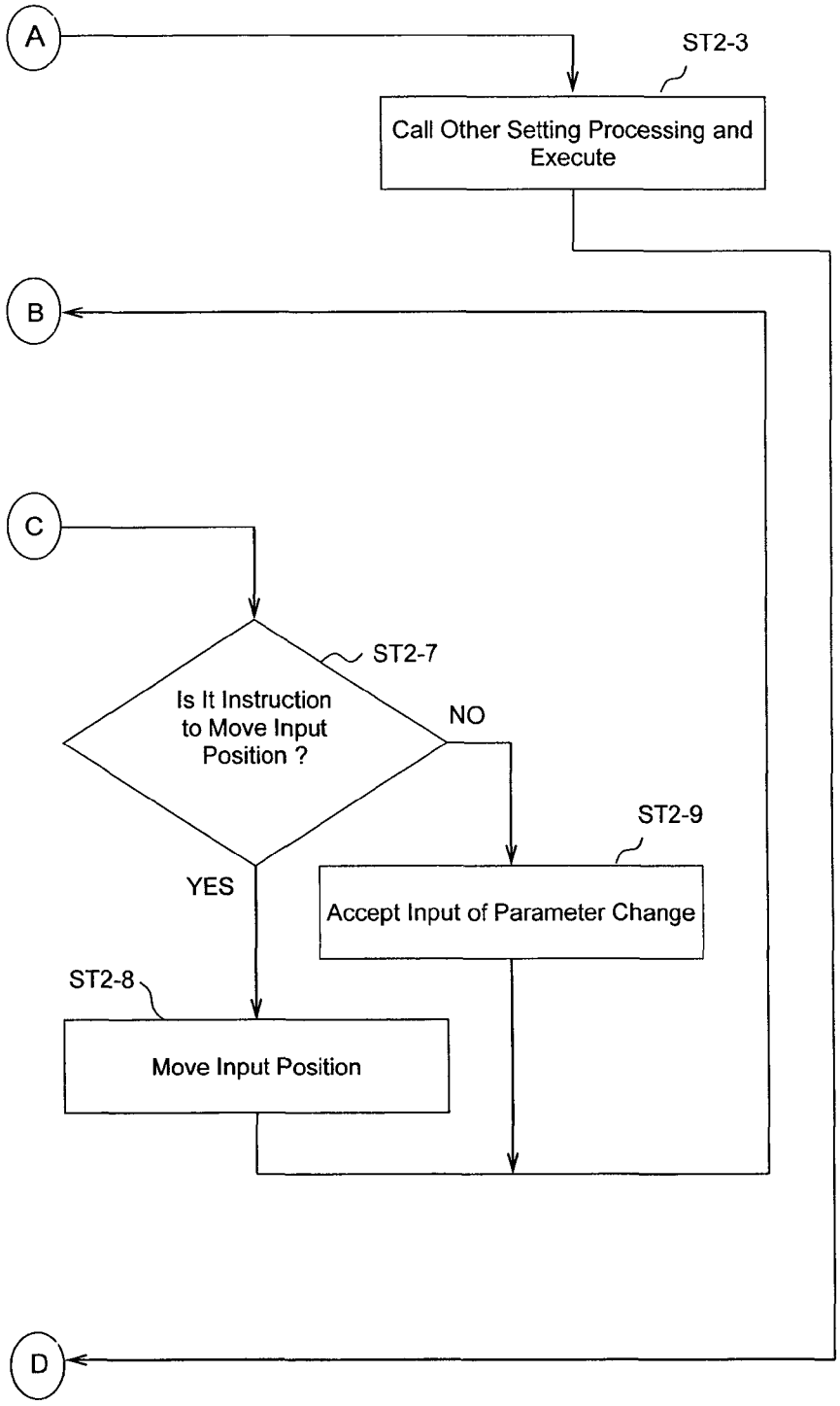
Figure 11:
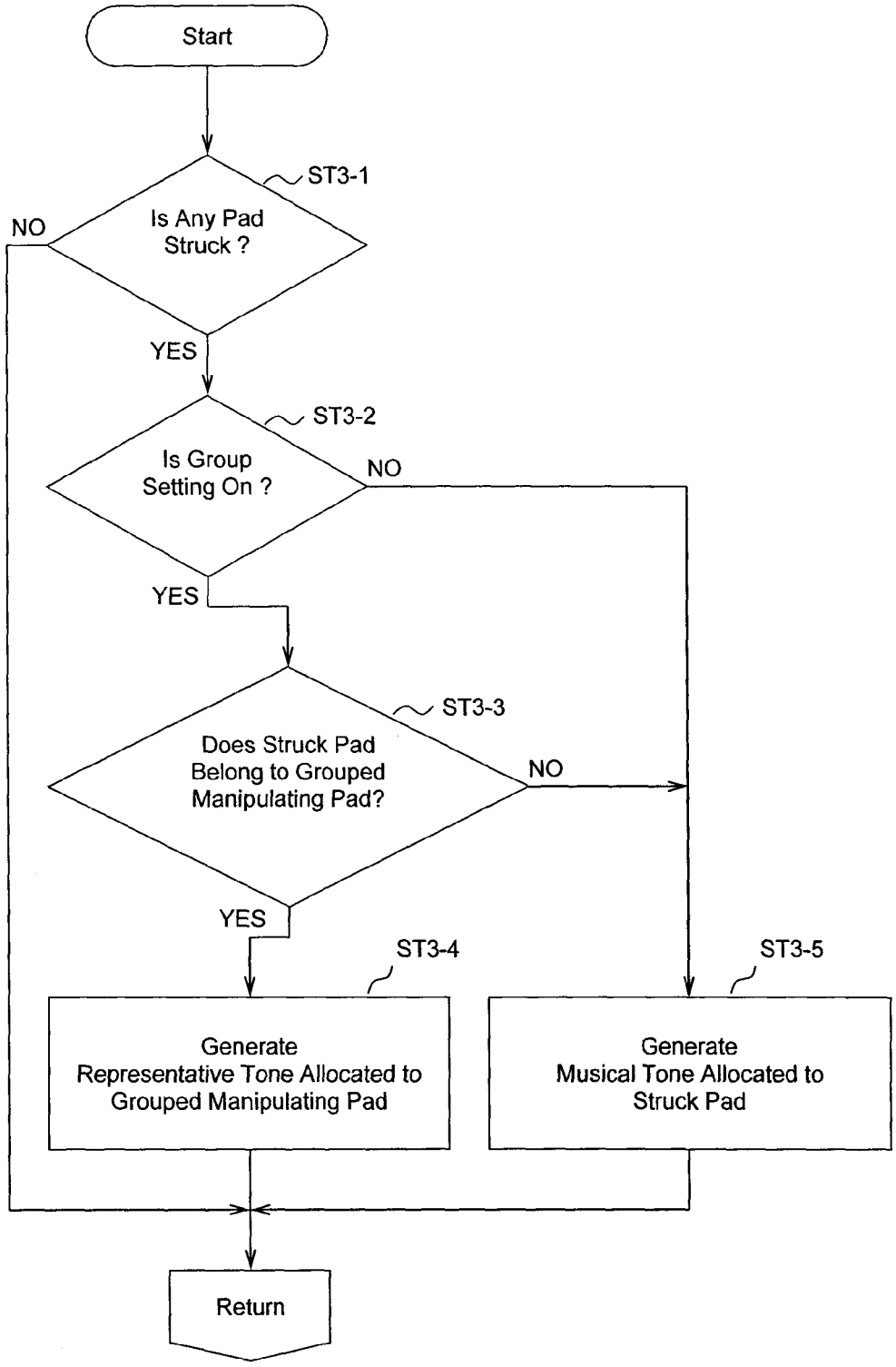
Figure 12:
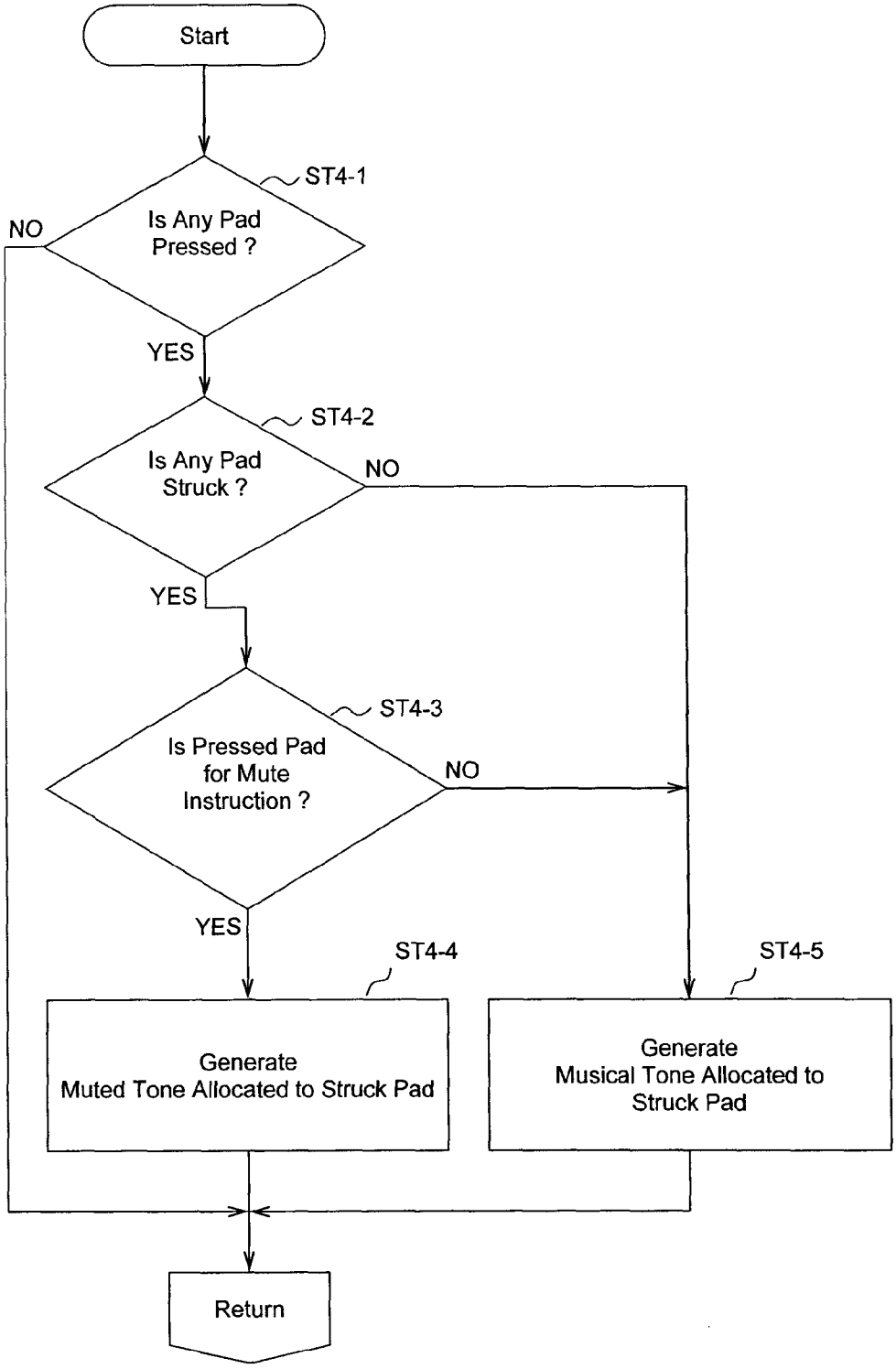
Figure 13:
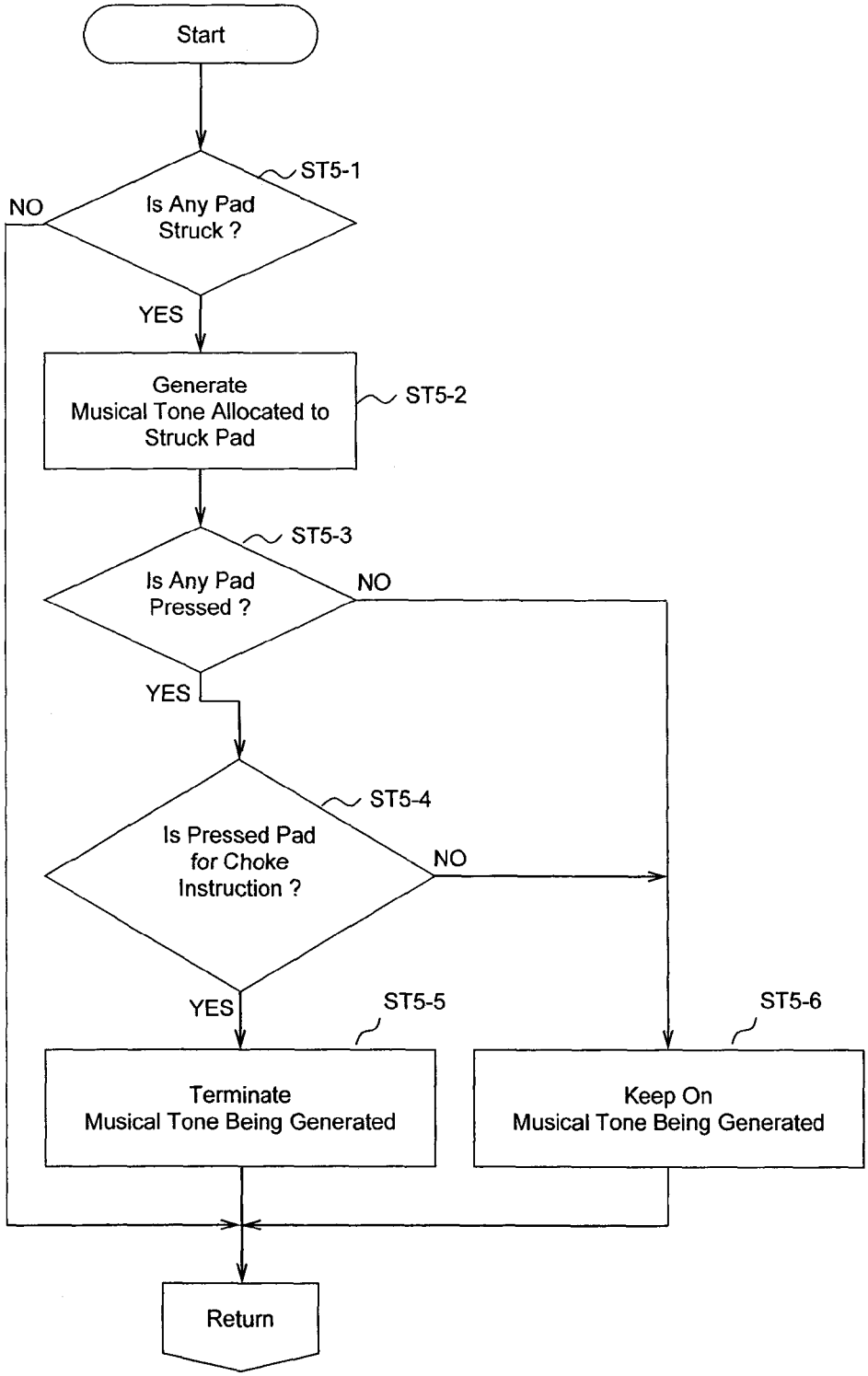
Figure 14:
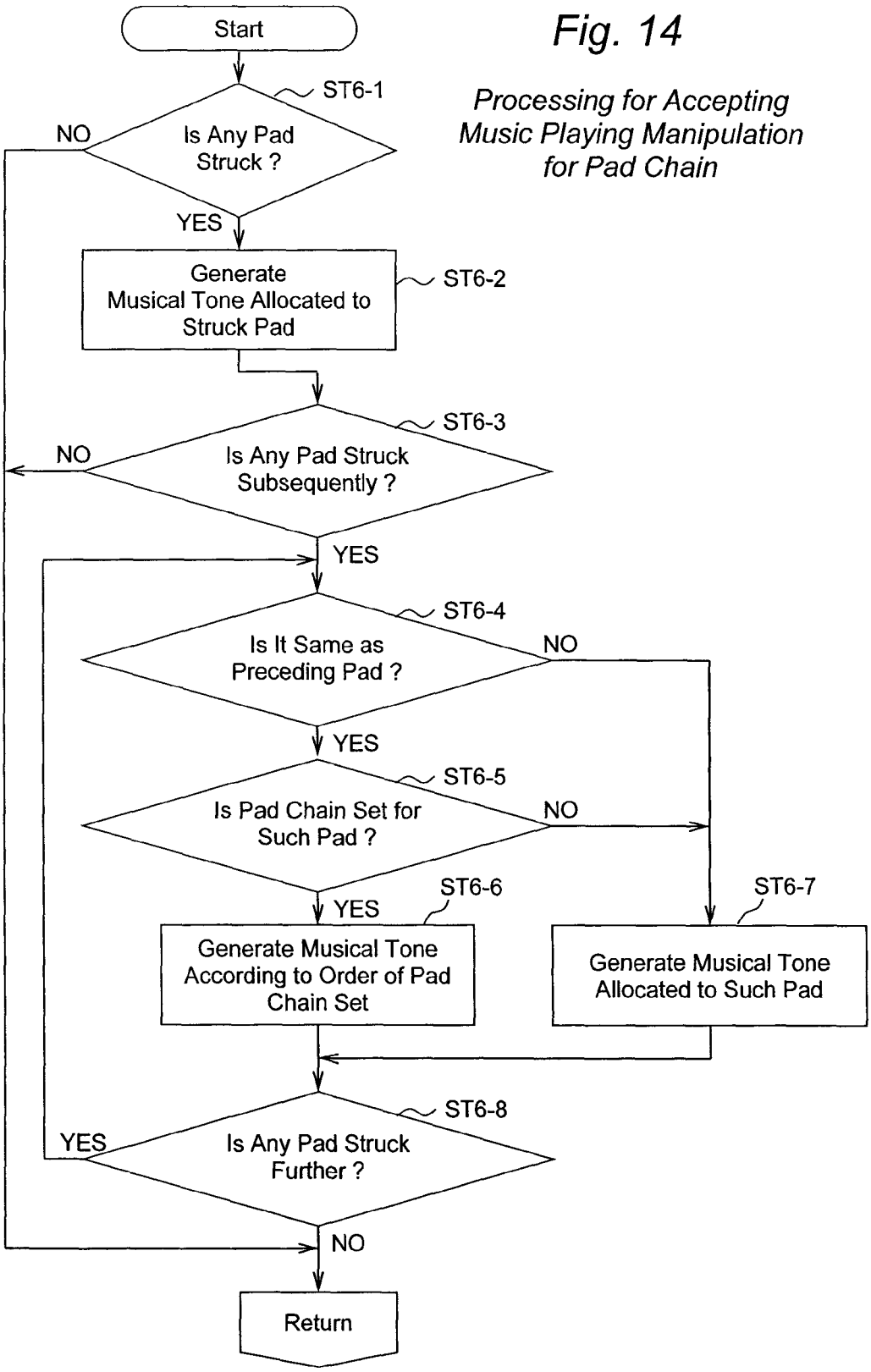
Figure 15:
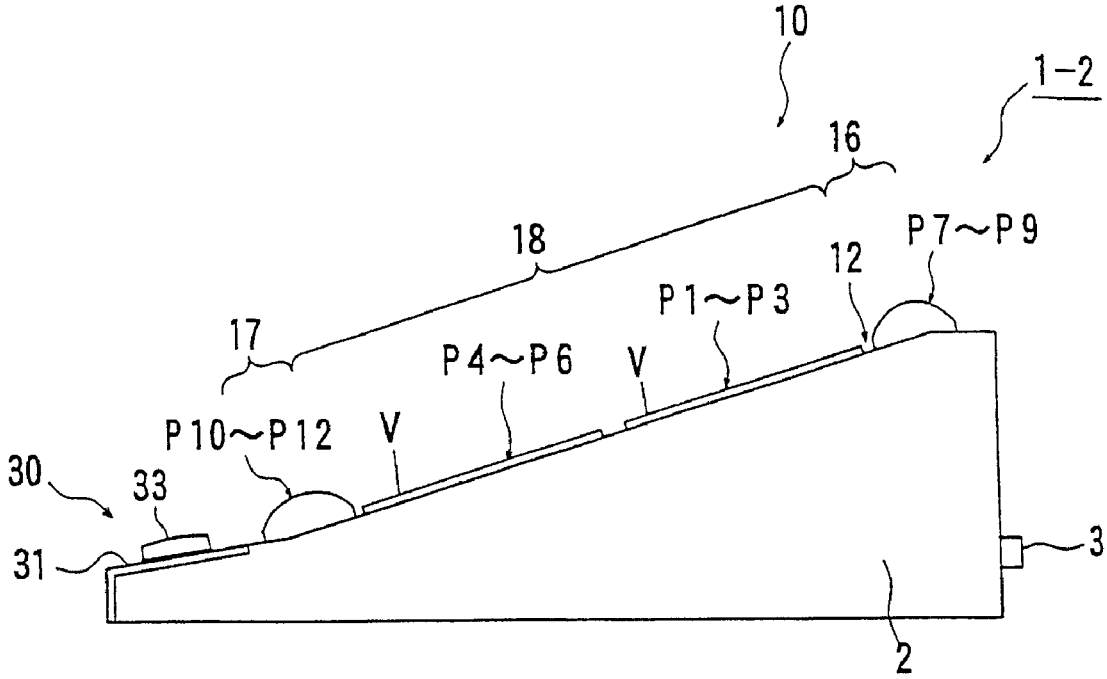

FIG. 3 is a block diagram showing the hardware configuration of an electronic percussion instrument according to an embodiment of the present invention;

FIG. 4 is a plan view showing the configuration of the pads with their pad numbers and pad names indicated in an embodiment of the present invention;

FIG. 5 is a plan view showing an example of the contents of a displayed screen for control setting;

FIGS. 6*a*-6*f* are plan views each showing the configuration of the pads with their pad numbers and pad names, including individual pads or grouped pad zones in different grouping;

FIG. 7 is a plan view showing another example of the contents of a displayed screen for control setting;

FIG. 8 is a plan view showing a further example of the contents of a displayed screen for control setting similar to FIG. 5;

FIG. 9 is a flow chart showing the main routine processing in an electronic percussion instrument according to an embodiment of the present invention;

FIGS. 10*a* and 10*b* are, in combination, a flow chart showing the processing for accepting a control setting manipulation as conducted in the step ST1-2 of FIG. 9;

FIG. 11 is a flow chart showing the processing for accepting a music playing manipulation for an individual pad or a grouped pad zone as conducted in the step ST1-3 of FIG. 9;

FIG. 12 is a flow chart showing the processing for accepting a music playing manipulation under a mute instruction as conducted in the step ST1-3 of FIG. 9;

FIG. 13 is a flow chart showing the processing for accepting a music playing manipulation under a choke instruction as conducted in the step ST1-3 of FIG. 9;

FIG. 14 is a flow chart showing the processing for accepting a music playing manipulation for a pad chain operation as conducted in the step ST1-3 of FIG. 9; and FIG. 15 is a side elevational view showing an electronic percussion instrument according to another embodiment of the present invention.

DETAILED DESCRIPTION OF EMBODIMENTS OF THE INVENTION

The present invention will now be described in detail with reference to the drawings showing preferred embodiments thereof. It should, however, be understood that the illustrated embodiments are merely examples for the purpose of understanding the invention, and should not be taken as limiting the scope of the invention.

FIG. 1 shows a plan view illustrating an electronic percussion musical instrument 1 according to an embodiment of the present invention, FIG. 2*a* shows a side elevational view illustrating the electronic percussion instrument 1 of FIG. 1, and FIG. 2*b* shows a cross-sectional front view showing an outline of the pads P (P4-P6) included in the embodiment of FIG. 2*a*. The electronic percussion instrument 1 is a desktop-type electronic musical instrument built within a case 2 having the shape of a roughly flat box. The most of the area from the rear end over the instrument 1 is occupied by a music playing manipulation device 10 comprised of a plurality of arrayed pads P (P1-P12), and the narrow area in the angular front end over the instrument 1 is provided with a setting control device 30 comprised of a control panel 31. As shown in FIG. 2*a*, the rear face of the case 2 is provided with a terminal assembly 3 including connection terminals for connecting external apparatuses as well as a power supply.

The music playing manipulation device 10 is configured over the case 2 to cover the upper face of the case 2. The music playing manipulation device 10 has a contour of a generally rectangular shape and is sectioned into a matrix form having plural rows juxtaposed in a depth direction and plural columns juxtaposed in a width direction, as view from the player of the instrument 1. Each of the sectioned face zones in the matrix is provided with a manipulating pad P (P1-P12). In the illustrated embodiment, the music playing manipulation device 10 has twelve pads P1-P12 arrayed in four rows and in three columns.

Three pads P7, P8 and P9 are arrayed in a rear lateral row and other three pads P10, P11 and P12 are arrayed in a front lateral row, each of which pads has a plan view contour of a laterally elongate rectangular shape as seen in FIG. 1 and a side view contour of a sectoral shape as seen in FIG. 2*a*, and each of which pads constitutes a protruded three-dimensional body, the upper arcuate surface serving as a beating surface. The pads P7-P9 in the rear row will be collectively referred to herein as a first three-dimensional manipulating device 16, and the pads P10-P12 in the front row as a second three-dimensional manipulating device 17.

Six pads P1-P6 are arrayed between the first three-dimensional manipulating device 16 and the second three-dimensional manipulating device 17, each of which pads has a plan view contour of a generally rectangular shape as seen FIG. 1 and a side view contour of a thin planar shape as seen in FIG. 2*a*. The pads P1-P6 will be referred to herein as a two-dimensional manipulating device 18. The pads P1-P6 in the two-dimensional manipulating device 18 arranged aslant descending toward the front of the case 2 so that the manipulating face V will face toward the player. The three rear pads P1-P3 slant by a same inclination and the three front pads P4-P6 slant by another same inclination, where the inclination of the pads P1-P3 is greater than the inclination of the pads P4-P6. Thus, the player can easily and correctly recognize both the rear pads P1-P3 and the front pads P4-P6, so that the player can strike both of the rear and the front pads without an error. Further, a height difference T (of the manipulating faces V's) is provided between the front edge of the rear pads P1-P3 and the rear edge of the front pads P4-P6. This difference T will make the border between the rear pads P1-P3 and the front pads P4-P6 clearly recognizable, and the player can distinctively aim and strike either the rear pads P1-P3 or the front pads P4-P6, which will enhance the maneuverability of the percussion instrument. Further, as the front edge W of the rear pads P1-P3 overhangs frontward, strikes against the edge area W (e.g. striking the edge W with the middle body of the stick) will also be available, which broadens the usefulness of the pads P1-P6 in the two-dimensional manipulating device 18.

In the electronic percussion instrument 1 of this embodiment, as demarcated by the height-difference T zone, the rear half part of the manipulating area includes the pads P7-P9 in the first three-dimensional manipulating device 16 and the rear pads P1-P3 lying in a same plane, while the front half part of the manipulating area includes the pads P10-P12 in the second three-dimensional manipulating device 17 and the front pads P4-P6 lying in another same plane, as seen from FIG. 2*a*.

The pads P7-P9 in the first three-dimensional manipulating device 16 and the pads P10-P12 in the second three-dimensional manipulating device 17 are suitable for the music playing manipulations in which the player strikes the cylindrically protruded beating face V with the middle body (side) of the stick. The pads P1-P6 in the two-dimensional manipulating device 18, on the other hand, are suitable for the music playing manipulations in which the player strikes the flat planar beating face V with the tip end of the stick. In addition to the strikes using the beating sticks, the pad may be beaten by any part of the players body such as a hand or the pad may be simply pressed by, for example, a palm to input an instruction for an effect of special playing technique, such as muting a tone to be generated and choking a generated tone, which will be described herein later. As the first three-dimensional manipulating device 16 and the second three-dimensional manipulating device 17 are located at the distal end and the proximal end, respectively, of the two-dimensional manipulating device 18, the percussion instrument of this embodiment can be used as a drum having a beating membrane (drum head) surrounded by a rim. The provision of the first three-dimensional manipulating device 16 to the rear of the two-dimensional manipulating device 18 and the second three-dimensional manipulating device 17 to the front of the two-dimensional manipulating device 18 substantially simulates the structure of the drum having a rim surrounding a beating membrane.

As shown in FIG. 2*b*, the manipulating face V of the pad P is made of a surface sheet 21 of an elastic material such as rubber. The adjacent pads P are demarcated by a groove 12 provided in the form of a grid, defining twelve pad zones P1-P12. To the under surface of the elastic core 21 is provided a touch sensor 22. The touch sensor 22 is a pressure sensitive sensor of a sheet form, which detects a pressing manipulation by the player on to the beating face V using a hand or else in the case of the tone muting technique or the tone choking technique, which will be described herein later. Further, the touch sensor 22 is also designed to detect the position of the strike on to the pad P. To the under surface of the touch sensor 22 is attached a core plate (pad body) 23. The core plate 23 is elastically supported on a support frame 24 which is provided beneath the music playing manipulating device 10, via elastic members 25 made of rubber or the like material. An impact sensor 26 formed in the shape of a small plate piece is provided in surface contact with the under surface of the core plate 23. The impact sensor 26 is made, for example, of a piezoelectric material which can detect the vibration caused by the strike on to the pad P and output an electric signal representing the vibration. The impact sensor 26 can detect the intensity of the strike exerted to the pad P.

The electronic percussion instrument 1 of this embodiment stores, in a storage device 47 or a ROM 43, data of musical tones of various timbres (drum sound, cymbal sound, etc.) for the generation of musical tones in response to the strikes on the pad P in a musical performance. The musical tone data can be coded data as well as sample data which are obtained by sampling actual waveform signals. The instrument 1 may be provided with a sampling circuit to obtain sample data from the actual waveforms input thereto.

On the control panel 31 of the setting control device 30 are arranged various control buttons 32 including cursor keys, input keys and so forth, a control knob 33 for controlling the volume, a display screen 34 comprised of a liquid crystal panel, a sound output device 36 including a loudspeaker for emitting sounds of the performed musical tones and other sounds and voices, etc. The display screen 34 is to exhibit a screen image for conducting various control setting. The control panel 31 is formed in the shape of a slope face having the distal edge disposed highest and close to the proximal edge of the music playing manipulation device 10 and lowest toward the front edge of the case 2, as shown in FIG. 2*a*. The inclination of the control panel 31 is steeper than the inclination of the music playing manipulating device 10. The control panel 31 arranged at such a location and with such an inclination will decrease the possibility of erroneously hitting the control panel 31, the control buttons 32 and the control knob 33 in the case of manipulating the pad at its part near to the setting control device 30 by means of the sticks or the hands. This will enhance the maneuverability of the electronic percussion instrument 1. As will be seen in FIG. 2*a*, the second three-dimensional manipulating device 17 which locates adjacent to the boarder of the control panel 31 protrudes toward the player, and accordingly the striking manipulation against the pads P10-P12 belonging to the second three-dimensional manipulating device 17 by means of the body portion of the stick will be easily and correctly performed.

Further, the size and the shape of the display screen 34 in the illustrated embodiment are miniaturized and simplified so as to be contained within a small part of the control panel 31. This will greatly help in miniaturizing the total size of the electronic percussion instrument 1 as a whole. The simplification of the display screen 34 will also help in decreasing the cost of the electronic percussion instrument 1. Further, the miniaturization of the display screen 34 will help in securing the space for accommodating the music playing manipulation device 10 without enlarging the general size of the electronic percussion instrument 1, which will also enhance the maneuverability of the instrument 1.

FIG. 3 shows a block diagram illustrating the hardware configuration of an electronic percussion instrument 1 of the above described embodiment of the present invention. The electronic percussion musical instrument 1 comprises a music playing manipulation unit 10, a setting controls unit 30, a tone generator (tone signal generating circuit) 41, a sound system 42, a ROM (read-only memory) 43, a RAM (random access memory) 44, a main control unit (such as a CPU) 45, a timer 46, a storage unit 47, a display unit 34 and an interface unit 48, which are all interconnected by a bus 50.

The music playing manipulation unit 10 is equipped with the twelve playing pads P1-P12, each pad P being provided with the impact sensor (piezoelectric sensor) 26 and the touch sensor (sheet sensor) 22 as described above. The sensors 26 and 22 are connected to the bus 50 via a pad interface 13. The main control unit (CPU) 45 serves to control the overall operation of the electronic percussion instrument 1. The main control unit 45 also works as the processing units or devices for processing various process steps according to the associated programs in response to various manipulations for setting controls and for playing music, such as a music tone allocating unit and a group setting unit as will be described herein later.

The timer 46 counts the clock pulses and tells various process time points for timer interrupt processing and other processing. The ROM 43 stores the main control programs executed by the main control unit 45, and various application programs and data including control programs and data tables. The ROM 43 may also store the data concerning the musical tones to be allotted to the respective pads P. The RAM 44 temporarily stores automatic performance data, various input information, the computed results during processing, etc. The storage unit 47 comprises storage media such as a hard disk drive (HDD) and a flash memory, and can store various setting information and performance data. The display unit 34 is constituted by a liquid crystal display (LCD) for displaying various information. The display unit 34 may also be constituted by light emission diodes (LED's). The interface 48 is to connect external music playing apparatuses 49 for inputting various signals (e.g. MIDI signal) from the external apparatus 49 and to output various signals to the external apparatus 49. The tone generator 41 is to convert the performance data input by the manipulations on the music playing manipulation unit 10 or the automatic performance data previously set in the instrument 1 into musical tone signals. The sound system 42 includes an amplifier and a loudspeaker for converting the musical tone signals from the tone generator 41 into audible sounds.

In the electronic percussion instrument 1 of this embodiment, the twelve playing pads P1-P12 of the music playing manipulation device 10 are numbered and named. FIG. 4 shows an example of such numbering and naming. In the example of FIG. 4, the three pads P1-P3 located in the rear half of the two-dimensional manipulating device 18 are numbered as #1, #2 and #3 in this order, the three pads P4-P6 located in the front half of the two-dimensional manipulating device 18 are numbered as #4, #5 and # 6 in this order, the three pads P7-P9 belonging to the first three-dimensional manipulating device 16 are numbered as #7, #8 and #9 in this order, and three pads P10-P12 belonging to the second three-dimensional manipulating device 17 are numbered as #10, #11 and #12 in this order. The twelve pads P1-P12 are given different names (alphabetical symbols), respectively. The correspondence between the pad numbers and the pad names is as follows. #1: HHU, #2: HNU, #3: HMU, #4: HHS, #5: HNS, #6: HMS, #7: RHU, #8: RNU, #9: RMU, #10: RHS, #11: RNS, and #12: RMS. These data concerning the pad numbers and the pad names are stored in the storage unit 47. It should be noted that the illustrated pad numbers and the pad names are just for an example, and that any other appropriate numbers and the names may be given to the pads P1-P12 other than the illustrated ones as long as they can identify the respective pads and differentiate one from the others.

FIG. 5 shows a plan view illustrating an example of the contents of a displayed screen 35 for control setting as exhibited on the display unit 34. The displayed screen 35 for control setting is in the format of a list (or table) for inputting various information relating to various control setting such as allotment of timbres of the musical tones and the setting of special playing technique effects. The display screen 34 may not necessarily cover the entire table of FIG. 5, but may cover only a fraction at a time of the table and may be scrolled or switched over to the remaining fractions as long as the necessary input positions can be presented some after some others in sequence. Using the displayed screen 35 for setting various items in the electronic percussion instrument 1, the player can set various items including setting the allocation of the musical tones (timbres) to the pads P, setting the pads for instructions of the tone muting effect and of the tone choking effect, setting grouped pad zone or zones, setting pad chain effect of generating different tones in the set sequence under the successive strikes on the same pad. The each setting will be described in more detail herein later. The values inside the thick frame (rectangle) in FIG. 5 are changeable according to the setting operation by the player.

Setting For Allocation of Timbres To Pads:

In the example of the table of FIG. 5, different (to each other) timbres (Timbre A-Timbre O) are allocated to the first through twelfth pads P1-P12. The timbres A through O are of various actual percussion instruments, for example, a bass drum, a snare drum, a high hat, a high tom, a mid tom, a low tom, crash cymbals, ride cymbals, high-hat cymbals and so forth. The tone data can be electronic data for synthesizing such timbres or data of sampled waveform of such timbres. Any other timbres may be used. The tone data are stored in the ROM 43 or in the storage unit 47, and when a particular pad P is manipulated by the player, the main control unit 45 calls the tone data of the timbre allocated to the manipulated pad P from the ROM 43 or the storage unit 47 and makes the tone generator 41 generate the musical tone of that timbre.

Further in the example of FIG. 5, alternate timbres are set as the tone data for the pad #2, #8 and #12. Where alternate timbres are set for a pad, successive strikes on the pad are to cause the generation of the plurality of set timbres in the predetermined order of sequence. In other words, when the pad is struck a plurality of times successively, the first strike causes the generation of tones of the first one among the allocated timbres, the second strike causes the generation of tones of the second one among the allocated timbres, and so forth. More specifically with reference to FIG. 5, the timbre B and the timbre M are allocated to the pad #2, and this means that when the pad #2 is successively struck, musical tones of the timbre B and musical tones of the timbre M will be alternately generated. Three or more timbres may be allocated to one pad.

For each pad, the number of tones to be generated in response to one strike on the pad is not necessarily limited to one (i.e. one tone per one strike), but may be a number of tones one after another to constitute a phrase. While the above description has been about the case where the timbres (timbre defining parameters) previously stored in the electronic percussion instrument 1 are allocated to the respective pads, sampled tone waveforms (the data obtained by sampling actual tone waveforms) may be allocated to the pads, especially where the instrument 1 is equipped with a sampling circuit which can sample externally input tone signals. In addition to the above-mentioned setting of the tone data of a single timbre per pad or of the tone data of alternate timbres per pad, a stack of timbres may be set per pad so that plural timbres of tones will be generated simultaneously in response to one strike on the pad.

Setting For Pad Chain Play:

A pad chain play means in this context a manner of playing the electronic percussion instrument 1 of this embodiment in which the player strikes the same particular pad P plural times in succession and then the instrument first generates the tone (timbre) allocated to that particular pad in response to the first strike on that particular pad P, and next generates the tone (timbre) allocated to another pad in response to the second strike on the same particular pad P, and so forth according to the order of pads in the sequence set for the pad chain play. The orders of pads in the sequences are set in two ways. The one is by user setting and the other is by factory setting. In the user setting, the user can arbitrarily set an order of timbres (represented by pad numbers) to be generated in sequence for each pad. In the factory setting, an order of timbres to be generated in sequence is previously set for each pad at the manufacture of the percussion instrument 1 in the factory. The user setting may be such that the user can freely set the timbres and the order or such that the user can select a desired one from among a plurality of previously set sequences.

In the example of FIG. 5, the user has set for pad #1 a pad chain play sequence comprised of the pad #1 timbre, the pad #2 timbre and the pad #3 timbre in this order. So, if the player strikes pad #1 four times successively, the musical tones of timbre A, timbre B, timbre M and timbre C will be generated one after another in this order. The fifth strike and the strikes thereafter will repeat this same sequence. For the pad #2, the pad chain play sequence is set by the user to be pad #2 timbre, pad #3 timbre and pad #1 timbre in this order.

Some specific examples will be enumerated herein-below with respect to the manipulated pads by the player (before the equal sign) and the generated timbres (after the equal sign).

Example 1: Pad #1=Timbre A-->Pad #3=Timbre C-->Pad #1=Timbre A-->Pad #1=Timbre B-->Pad #2=Timbre B.

Example 2: Pad #5=Timbre E-->Pad #5=Timbre E-->Pad #5=Timbre E-->Pad #1=Timbre A-->Pad #1=Timbre B.

Example 3: Pad #2=Timbre B-->Pad #2=Timbre M-->Pad #2=Timbre C-->Pad #7=Timbre G-->Pad #1=Timbre A.

In the pad chain setting, in the case where the player strikes a pad P for which a pad chain play sequence is set, and next strikes another pad P, and thereafter strikes the previous same pad P again, the timbre to be generated by the last-mentioned strike can be the timbre determined by following the running pad chain play sequence, or can be the initial timbre in the pad chain play sequence by resetting the pad chain use after another pad P is struck (has interrupted). Either mode may be employed according to the design of the instrument 1, or according to the selection by the user. For example, after the "manipulation=generation" sequence of Pad #1=Timbre A-->Pad #1=Timbre B-->Pad #3=Timbre C, if Pad #1 is struck again in succession, the timbres to be generated can be Timbre M-->Timbre C by following the running pad chain sequence, or can be Timbre A-->Timbre B by resetting the pad chain use.

Tone Muting Technique:

The tone muting technique is a playing technique of generating musical tones in a muted timbre of an instrument voice, for example, by striking the playing face of an ordinary (acoustic) musical instrument by the sticks or hands with the playing face being pressed with a hand or else, thereby generating softened or muffled tones. (The term "to mute" does not mean "to silence" or "to extinguish" in this context.) The electronic percussion instrument 1 of this embodiment is capable of detecting the pressing manipulation against the pad P by means of the touch sensor 22 attached to the pad P. When the touch sensor 22 detects the pressing manipulation, the timbre of the tone to be generated in response to a strike against the pad P is modified to a muted tone which is different from its unmuted normal tone, thereby imitating the tone muting performance on an ordinary percussion instrument. In a percussion musical instrument 1 having a plurality of manipulating pads, the pad P to be struck for tone generation and the pad P to be pressed for muting technique may be the same pad P or may be different pads P.

FIG. 5 shows an embodiment in which the mute instruction for the pad #1 is given by pressing the pad #7, and thus when the player strikes the pad #1 while pressing the pad #7, a mute instruction is made for the pad #1, and a musical tone of the timbre A is generated in a muted fashion. The table of FIG. 5 indicates that pad for instructing the mute effect to the tones of the pad #1 is set to be the pad #7. Likewise, the pads for instructing the mute effect to the tones of the pads #4, #5, #6, #10 and #12 are set to be the pads #1, #2, #3, #4 and #3, respectively. The pads for mute instruction may be arbitrarily set by the user on the setting screen of FIG. 5 or may be selected from among the previously stored examples.

Tone Choking Technique:

The tone choking technique is a playing technique of stopping or rapidly damping the musical tones being generated, for example, by pressing with a hand or else the vibrating face which has been struck by the sticks or hands and is now generating the tone. The electronic percussion instrument 1 of this embodiment is capable of detecting the pressing manipulation against the pad P by means of the touch sensor 22 attached to the pad P as described above. When the touch sensor 22 detects the pressing manipulation, the musical tone which has been being generated up to that moment is stopped or rapidly damped, thereby imitating the tone choking performance on an ordinary percussion instrument. In addition to such effect of stopping or rapidly damping the generated tone, some special effect sounds (so-called "choke sounds") which usually happen during the choking manipulation on the ordinary instrument may also be employed.

In the embodiment shown in FIG. 5, the choke instruction for the pad #1 is given by pressing the pad #7, and thus when the player strikes the pad #1 and thereafter presses the pad #7, a choke instruction is made for the pad #1, and a musical tone of the timbre A is stopped or rapidly damped at that moment. The table of FIG. 5 indicates that pad for instructing the choke effect to the tones of the pad #1 is set to be the pad #7. Likewise, the pads for instructing the choke effect to the tones of the pads #4, #6 and #10 are set to be the pads #1, #2 and #4, respectively. The pads for choke instruction may be arbitrarily set by the user on the setting screen of FIG. 5 or may be selected from among the previously stored examples.

The pad P to be struck for tone generation and the pad P to be pressed for choke technique may be the same pad P or may be different pads P. The pad P for instructing the choke effect and the pad P for instructing the mute effect for the timbre of one striking pad P may be the same pad P in common or may be different pads. In the example of FIG. 5, the mute instruction and the choke instruction for the timbre of the pad #1 are made by means of the pad #7. For the timbre of the pad #6, however, the mute instruction is made by means of the pad #3 and the choke instruction is made by means of the pad #2.

Further, where the mute effect or the choke effect are used under the pad chain operation mode, the mute instruction pad (pressing pad) or the choke instruction pad (pressing pad) may work for the directly set timbre pad (striking pad), or may also work for the indirectly set timbre pads (striking pads) in the sequence of the pad chain.

Group Setting:

The group setting is a function in which a plurality of pads are combined together into a single integrated pad zone to work just like an enlarged pad, so that the player can play the electronic percussion instrument 1 as if it had an enlarged pad. In this embodiment, the twelve pads P1-P12 can be variously grouped. The grouping may be selected from among the previously prepared grouping samples or may be arbitrarily determined by the player. FIG. 5 shows the case in which no grouping of the pads are set, i.e. all the pads P1-P12 are individual pads constituting ungrouped pad zones, respectively.

FIGS. 6*a*-6*f* show plan views of the pads which are differently set in terms of grouping, respectively, in which each Figure illustrates the configuration of the pads with their pad numbers and pad names. The pads #1-#12 are arrayed in a matrix fashion in four rows and three columns. FIG. 6*a* shows the case in which no grouping is set and the twelve individual pads #1-#12 are to work separately, which is the case shown by the setting screen 35 of FIG. 5. FIG. 2*b* shows the case (i.e. a set condition) in which four pads #7, #1, #4 and #10 in the left column are grouped or combined into an integral grouped pad zone G1, while all the other pads #8, #9, #2, #3, #5, #6, #11 and #12 are left ungrouped and work as individual playing pads separately. FIG. 2*c* shows the case in which six pads #1-#6 belonging to the two-dimensional manipulating device 18 are grouped into a single grouped pad zone G3, three pads #7-#9 belonging to the first three-dimensional manipulating device 16 are grouped into another single grouped pad zone G2, and three pads #10-#12 belonging to the second three-dimensional manipulating device 17 are grouped into a further single grouped pad zone G4. FIG. 2*d* shows the case in which the pads are grouped into three groups column by column, with four pads #7, #1, #4 and #10 in the left column being grouped into an integral grouped pad zone G5, four pads #8, #2, #5 and #11 in the middle column being grouped into another integral grouped pad zone G6, and four pads #9, #3, #6 and #12 in the right column being grouped into a further integral grouped pad zone G7. FIG. 6*e* shows the case in which three pads #7-#9 belonging to the first three-dimensional manipulating device 16 and three pads #1-#3 belonging to the rear half of the two dimensional manipulating device 18 are grouped into an integral grouped pad zone G8, while three pads #4-#6 belonging to the front half of the two dimensional manipulating device 18 and three pads #10-#12 belonging to the second three-dimensional manipulating device 17 are grouped into another integral grouped pad zone G9. FIG. 2*f* shows the case in which all the pads #1-#12 are grouped into a single integral grouped pad zone G10. While six patterns of the group setting are illustrated in the Figures and described above, there can be further different specific patterns of the group setting.

FIG. 7 shows a plan view of another example of the contents of a displayed screen 35-2 for conducting the pad chain setting, the group setting, and the playing technique mode setting when a group setting has been made. The manner of the pad chain setting can be selected from among three conditions, i.e. pad chain off, user setting and factory setting. When the "user setting" is selected, the contents in the column of "User Setting" in the table 35 of FIG. 5 are made rewritable according to the user's new inputs and the rewritten contents are made valid for the respective pads #1-#12 so that the manipulations (i.e. strikes) in succession on any single pad will generate the timbres according to the pad chain set for such a single pad. When the "Factory Setting" is selected, the contents in the column of "Factory Setting" in the table 35 of FIG. 5 are set by the stored data and are made valid for the respective pads #1-#12. Thus, the order of timbres generated under the pad chain operation of the instrument 1 can be arbitrarily set by the user or can be selected from among the predetermined (factory-set) orders prepared for the pad chain plays.

The manner of the group setting can be selected from among four conditions, i.e. group setting off, user setting, factory setting A and factory setting B. When the "user setting" is selected, the contents in the column of "Group Setting" in the table 35 of FIG. 5 are made rewritable according to the user's new inputs to arbitrarily set the grouping of the pads. When the "Group Setting A" or the "Group Setting B" is selected, the contents in the column of "Group Setting" in the table 35 of FIG. 5 are set by the stored data and the pads are grouped into grouped pad zones as will be described herein later with reference to FIG. 8. The playing technique modes when the pad grouping is set can be selected from among two modes A and B concerning the playing technique instructions for the muting and the choking when the pads are grouped into pad zones.

FIG. 8 shows another example of the table 35 (similar to FIG. 5) displayed on the display screen 34 for control setting, in which the pads are grouped into three pad zones G3, G2 and G4 as depicted in FIG. 6*c*. More specifically, pads #1-#6 are combined into a grouped pad zone G3, pads #7-#9 into a grouped pad zone G2 and pads #10-#12 into a grouped pad zone G4. To these pad zones G3, G2 and G4 are allocated timbres A, G and G, respectively. Thus, all the pads included in each pad zone will work as a single pad having an enlarged area to which a single representative timbre is allocated. The representative timbre A allocated to the grouped pad zone G3 is the timbre which is allocated to pad #1 having the smallest pad number among the individual pads #1-#6 included in the grouped pad zone G3. Further, the representative timbre G allocated to the grouped pad zone G2 is the timbre which is allocated to pad #7 having the smallest pad number among the individual pads #7-#9 included in the grouped pad zone G2.

In addition, the same timbre G is allotted in common to the grouped pad zone G2 comprised of the pad P7-P9 constituting the first three-dimensional manipulating device 16 and to the grouped pad zone G4 comprised of the pad P10-P12 constituting the second three-dimensional manipulating device 17. This allocation is particularly useful in the case of handling the first and second three-dimensional manipulating devices 16 and 17 just like the opposite portions of the drum head rim surrounding the drum head membrane. In another case, the timbre allocated to the grouped pad zone G2 and the timbre allocated to the grouped pad zone G4 may be different.

As one timbre is allocated to one grouped pad zone, the setting operation of a timbre to a grouped pad zone can be conducted by one operation together for all the individual pads included in the grouped pad zone. In other words, the allocation of a representative timbre to the grouped pad zone G results in the allocation of the same timbre to all the individual pads P's belonging to the grouped pad zone G.

Further, in the electronic percussion instrument 1 of this embodiment, when two (or more) pads belonging to the same grouped pad zone are struck simultaneously (meaning both at a time and almost at a time with a very small time difference), only one tone of the allocated timbre will be generated. This will allow the player to strike the pads as if the grouped pad zone G were an enlarged pad.

A further different setting may be employed in the embodiment so that plural tones can be generated (while one tone is being generated, another tone will be added), when plural pads in one grouped pad zone are manipulated simultaneously. In such a case, whether one tone will be generated or plural tones will be generated may preferably be selected freely by the player by switching the modes by means of the displayed screen 35 or 35-2 for control setting. It is further possible to set the modes of whether to generate one tone or plural tone in response to strikes on plural pads G in one grouped pad zone, based on whether the time difference between the plural strikes is less than a reference time length or not. The reference time length may be variably set within the range of 10 ms through 50 ms. Further, where there are plural strikes (detections by the strike sensor 26) within the set reference time length, a tone shall be generated in response to the first strike only and no tone shall be generated in response to the following strikes, being suppressed by a control circuit. This can avoid a situation of erroneously judging as two or more strikes, when the player's intention is one strike. This is a kind of prevention of chattering (rejection) phenomena.

Group Setting+Muting Or Choking Technique:

An explanation will be made with respect to the situation where the grouped pad zones G2, G3 and G4 are set as depicted in FIG. 6*c*. The set conditions of the individual pads for the mute instruction and the choke instruction are valid for the individual pads, respectively, whether or not the pad belongs to a grouped pad zone. More specifically, in the case of FIG. 8, a mute instruction or a choke instruction is given through the pad (to be referred to as "instruction pad" for the sake of simplicity) listed in the column of "Mute Instruction" or "Choke Instruction" for the pad (to be referred to as "tone pad" for the sake of simplicity) having the pad number listed in the column of "#" in the table 35 of FIG. 8, thereby imparting a muting or a choking effect on the tone pad. On the other hand, the timbre (tone data) of the tone to be generated in response to a strike on the tone pad is allocated to a grouped pad zone G2, G3 or G4. For example, if pad #1 is struck while pressing pad #7, the mute instruction is for the tone of pad #1, and a tone of the timbre A is generated in a muted fashion accordingly. If pad #4 is struck while pad #1 is being pressed, a mute instruction for pad #4 is issued, as pad #1 is a mute instruction pad for the tone pad #4, and a tone of the timbre A is generated in a muted fashion. On the other hand, if pad #3 is struck while pad #1 is being pressed, a mute instruction is not issued for pad #3, as pad #1 is not a mute instruction pad for the tone pad #3, and a tone of the timbre A is generated in an unmuted fashion. Pads #3 and #6 are so set that both of the pads #3 and #6 are mute instruction pads for the both of the tone pads #3 and #6 mutually (for itself and for the other). In other words, pads #3 issues a mute instruction for both of the tone pads #3 and #6 and pads #6 issues a mute instruction for both of the tone pads #3 and #6. More specifically, if the pad #3 or #6 is struck for a tone generation of the timbre A with the pad #3 being depressed, the mute instruction is valid for the tone generation by pad #3 and #6, and a tone having the timbre A is generated in a muted fashion in response to the strike on the pad #3 or #6. When the pad #6 is being depressed for a mute instruction, the instrument 1 will work similarly.

Group Setting+Pad Chain Setting:

Again, an explanation will be made with respect to the situation where the grouped pad zones G2, G3 and G4 are set as depicted in FIG. 6*c*.

Setting For Pad Chain Play:

Where a pad chain is set for a grouped pad zone, the set pad chain sequence is valid for all of the individual pads belonging to the grouped pad zone. When a pad or pads belonging to the same grouped pad zone are struck in succession, tones having the timbres of the pads or pad zones which are designated in the pad chain sequence will be generated in the order of the pad chain sequence. In the case of FIG. 8, a pad chain sequence of "G3-->G2-->G4" is user set for the grouped pad zone G3, and the successive strikes on any of the pads in the grouped pad zone G3 will accordingly cause the generation of the tones having timbres A-->G-->G in this order and cyclically. For example, the successive strikes (before the equal sign) will generate the allocated timbres (after the equal sign), respectively, as follow. Pad #1=Timbre A-->Pad #3=Timbre G-->Pad #5=Timbre G.

When the successively struck pads do not belong to a single grouped pad zone, each of the timbres allocated to the grouped pad zone will be generated individually and not in a pad chain sequence. For example: Pad #1=Timbre A-->Pad #7=Timbre G-->Pad #10=Timbre G.

Group Setting+Pad Chain Setting+Muting Or Choking Technique:

In the case where a pad chain sequence is set for a grouped pad zone, a mute or choke instruction is valid for each nominated tone pad, and may also be designed to be valid for any tone pad belonging to the nominated grouped pad zone to generate the timbre allocated to the nominated grouped pad zone. Or, a mute or choke instruction for the nominated tone pad may be so designed to be valid when the grouped pad zone including the nominated tone pad is called according to the pad chain sequence executed by successive strikes on another grouped pad zone.

Herein below will be described with reference to FIGS. 9-14, the procedures for various processing conducted in the electronic percussion musical instrument 1 as described hereinabove. Among these Figures, FIG. 9 shows a flow chart illustrating the main routine processing in the electronic percussion instrument 1. according to an embodiment of the present invention, FIGS. 10*a* and 10*b* show, in combination, a subroutine flow chart illustrating the processing for accepting a control setting manipulation as conducted in the step ST1-2 of FIG. 9, FIG. 11 shows a subroutine flow chart illustrating the processing for accepting a music playing manipulation for an individual pad (i.e. ungrouped pad zone) or a grouped pad zone as conducted in the step ST1-3 of FIG. 9, FIG. 12 shows a flow chart illustrating the processing for accepting a music playing manipulation under a mute instruction as conducted in the step ST1-3 of FIG. 9, FIG. 13 shows a flow chart illustrating the processing for accepting a music playing manipulation under a choke instruction as conducted in the step ST1-3 of FIG. 9, and FIG. 14 shows a flow chart illustrating the processing for accepting a music playing manipulation for a pad chain operation as conducted in the step ST1-3 of FIG. 9.

The main flow processing is initiated when the power switch of the instrument 1 is turned on, and will be kept running until the power switch is turned off. The first thing executed is the initialization, in a step ST1-1, of various data and processes in the system. After the initialization, processing for accepting control setting manipulations is conducted in a step ST1-2. Subsequently, processing for accepting music playing manipulations and processing for musical tone generation take place in a step ST1-3. Thereafter, the processing for accepting the control setting manipulations, the processing for accepting the music playing manipulations and the processing for musical tone generation will be repeated in a loop.

FIGS. 10*a* and 10*b* illustrate, in combination, a flow chart of the processing for accepting the control setting manipulations as a subroutine processing in the step ST1-2 of FIG. 9. Firstly in this processing, a step ST2-1 judges whether a manipulation for setting any items is input by means of the setting controls unit 30. If the judgment is negative (NO), this subroutine does not conduct any particular processing for accepting control setting manipulations. If there is an input of control setting manipulation, the judgment is affirmative, and the processing flow goes forward to a step ST2-2 to judge whether it is a call of tone setting, mute or choke instruction setting, or pad chain setting. If the call is for setting items other than these, the judgment is negative (NO), and the process goes to a step ST2-3 to call and execute the requested setting process. If the call is for setting any one of the items (YES), a step ST2-4 displays a screen 35 for setting manipulation on the display unit 34, and a step ST2-5 accepts the item selection and the input using the screen 35 for setting manipulation. Subsequently, a step ST2-6 judges whether it is an instruction to execute the already input content, and if the judgment at the step ST2-6 is affirmative (YES), a step ST2-10 settles the contents input in the control setting screen 35 and store the same in the storage unit 47. If the input is not an instruction to execute (NO), a step ST2-7 judges whether it is an instruction to move the input position (cursor). If the judgment is affirmative (YES), a subsequent step ST2-8 moves the input position (cursor). If the input is not an instruction to move the cursor (NO), a further step ST2-9 accepts inputs of parameter changes (of various setting values). Thereafter, the steps ST2-4 and the subsequent steps up to the steps ST2-8 and ST2-9 will be repeated.

FIGS. 11-14 illustrate flow charts of the processing for accepting a music playing manipulation, for an individual pad or a grouped pad zone, under a mute instruction, under a choke instruction and for a pad chain operation, as all conducted in the step ST1-3 of FIG. 9, respectively. Hereinafter, description will be made about the processing for accepting music playing manipulations after the preceding processing for accepting control setting manipulations has been finished. The description will be made individually with respect to the group setting of the playing pads, the mute or choke instruction setting, and the pad chain setting.

FIG. 11 illustrates a flow chart of the processing for accepting a music playing manipulation for an individual pad or a grouped pad zone as a subroutine processing in the step ST1-3 of FIG. 9. Firstly, a step ST3-1 judges whether any of the pads P is struck, i.e. whether there is an input from the impact sensor 26. If the judgment result is negative (NO), the system stands by for any such input coming. If there is a strike on any pad P, the judgment at the step ST3-1 is affirmative (YES), and the process flow proceeds to a step ST3-2 to judge whether the group setting is on, i.e. whether there is any grouped pad zone G set by combining a number of individual pads P. If the group setting is not "on" (NO), the process flow moves forward to a step ST3-5 to generate a tone in the timbre which is allocated to the pad P struck just now. On the other hand, if the group setting is "on" (YES), the process flow proceeds to a step ST3-3 to judge whether the struck pad P belongs to any grouped pad zone G. If the struck pad P belongs to a grouped pad zone G (YES), the process goes to a step ST3-4 to generate a tone in the representative timbre allocated to the grouped pad zone G as a musical tone responsive to the struck pad P which belongs to the grouped pad zone G. If the struck pad P does not belong to a grouped pad zone G (NO), the process goes to the step ST3-5 to generate a tone in the timbre allocated to the pad P individually.

FIG. 12 illustrates a flow chart of the processing for accepting a music playing manipulation under a mute instruction as a subroutine processing in the step ST1-3 of FIG. 9. Firstly, a step ST4-1 judges whether any of the pads P is pressed, i.e. whether there is an input from the touch sensor 22. A pad P is pressed by exerting a static force onto the manipulating face (upper surface) of the pad P with a hand, fingers, or something else. If the judgment result is negative (NO), the system stands by for any such input coming. If there is a press on a pad P, the judgment at the step ST4-1 is affirmative (YES), and the process flow goes forward to a step ST4-2 to judge whether any of the pads P is struck, i.e. whether there is any input from the impact sensor 26. If the judgment at the step ST4-2 is negative (NO), the flow chart procedure returns to the main routine for the system to stand by for any strike on the pad P. If the judgment is affirmative (YES), the process flow proceeds to a step ST4-3 to judge whether the pressed pad P is for a mute instruction for the struck pad P. If the pressed pad P is for a mute instruction for the struck pad P (YES), the process flow moves forward to a step ST4-4 to generate a muted tone in the muted timbre allocated to the struck pad P. On the other hand, if the pressed pad P is not a pad for a mute instruction for the struck pad P (NO), the process goes to a step ST4-5 to generate a musical tone in the normal (unmuted) timbre allocated to the struck pad P.

FIG. 13 illustrates a flow chart of the processing for accepting a music playing manipulation under a choke instruction as a subroutine processing in the step ST1-3 of FIG. 9. Firstly, a step ST5-1 judges whether any of the pads P is struck. If there is no strike on a pad P (NO), the system stands by for any strike. If there is a strike on any pad P, the judgment at the step ST5-1 is affirmative (YES), and the process flow proceeds to a step ST5-2 to generate a musical tone in the timbre allocated to the struck pad P. And next, a step ST5-3 judges whether any pad is pressed within a predetermined time period from the strike on the struck pad P. If there is no press on any pad P within the predetermined time period (NO), the process flow goes to a step ST5-6 to keep on the musical tone which is being generated in response to the strike on the struck pad P. On the other hand, if there is a press on any pad P (YES), the process flow proceeds to a step ST5-4 to judge whether the pressed pad P is a pad for a choke instruction for the struck pad P. If the judgment result is affirmative (YES), the process moves forward to a step ST5-5 to terminate the musical tone which has been being generated in response to the strike on the struck pad P. On the other hand, if the pressed pad P is not a pad P for a choke instruction for the struck pad P (NO), the process flow goes to the step ST5-6 to keep on the musical tone which is being generated in response to the strike on the struck pad P. Alternatively, the step ST5-5 may be so designed to rapidly damp the musical tone being generated, or to turn the musical tone being generated into a tone of a choked (or muted) timbre instead.

FIG. 14 illustrates a flow chart of the processing for accepting a music playing manipulation for a pad chain operation as a subroutine processing in the step ST1-3 of FIG. 9. An explanation will be made with respect to the condition in which the group setting is off, i.e. no grouped pad zone G is set. Firstly, a step ST6-1 judges whether any pad P is struck. If there is no strike on any pad P (NO), the system stands by for any strike. If there is a strike on any pad P, the judgment at the step ST6-1 is affirmative (YES), and the process flow proceeds to a step ST6-2 to generate a musical tone in the timbre allocated to the struck pad P. And next, a step ST6-3 judges whether there is a subsequent strike onto any pad P. A subsequent strike means, in this context, a strike which is made after the preceding one irrespective of the length of the time lapse after the preceding one, i.e. the "a subsequent strike" may be just after the "preceding strike" and also may be long after the "preceding strike." If there is no subsequent strike, no further processes will be conducted in this flow chart of FIG. 14. On the other hand, if a subsequent strike is made (YES), the process flow proceeds to a step ST6-4 to judge whether the subsequently struck pad is the same as the preceding one. If the two pads are not the same (NO), the process flow goes to a step ST6-7 to generate a musical tone of the timbre allocated to the subsequently struck pad P. If the two pads are the same (YES), the processing moves forward to a step ST6-5 judges whether a pad chain play is set for the pad P. If a pad chain play is set for the pad P (YES), the process flow proceeds to a step ST6-6 to generate a tone according to the order of the tone in the pad chain sequence set for the pad P. The tone to be generated is determined according to the order of the timbre (represented by the pad #) in the sequence set in the pad chain column for the struck pad P as shown in the table of FIG. 5. On the other hand, if no pad chain play is set for the struck pad P (NO), the step ST6-5 directs the process flow to the step ST6-7, which in turn generates a musical tone of the timbre allocated to the subsequently struck pad P. After either of the steps ST6-6 and ST6-7, a step ST6-8 judges whether any further pad P is struck subsequently. If there is no further strike on any pad P (NO), the processing flow returns to the main routine. If there is a further strike on any pad P (YES), the process flow goes back to the step ST6-4, which is to judge whether the further struck pad P is the same as the preceding struck pad P.

For convenience in explaining the embodiment, the description of the processing has been made above individually with respect to the group setting, the muting technique, the choking technique and the pad chain play using separate flow charts with reference to FIGS. 11-14, respectively. The processing for accepting the music playing manipulations for the group setting, the mute instruction setting, the choke instruction setting and the pad chain setting will be conducted in a serial music playing processing by the electronic percussion instrument 1 according to the contents of various settings by the user. Therefore, the processing for accepting the group setting, the mute instruction setting, the choke instruction setting and the pad chain setting can be conducted not only separately, but also concurrently by intermingling the respective process steps in an appropriate configuration.

According to the electronic percussion instrument 1 of the above described embodiment, a grouped pad zone or zones can be set in the music playing manipulation device 10 by combining two or more pads P into a zone having an enlarged area. Thus, when a grouped pad zone (or zones) G is set, the player can play music by handling two or more pads P which belongs to the grouped pad zone G as the different parts of a single enlarged pad. On the other hand, when a grouped pad zone is not set, every pad P is used individually as an independent pad to generate a tone of the own allocated timbre. In this way, the plurality of individual pads can be combined freely in different sizes, and can be effectively utilized, so that the electronic percussion instrument 1 can be played in a variety of manipulating manners.

Further, as the electronic percussion instrument 1 of the above described embodiment comprises the two-dimensional manipulating device 18 comprised of the planar pads P1-P6 and the three-dimensional manipulating devices 16, 17 comprised of the cylindrical pads P7-P12, the player can strike the pads in different manners, i.e. in a wide range of manipulations. For example, the pads P1-P6 can be struck by the tip end of the stick while the pads P7-P12 can be struck by the middle body portion of the stick, namely in different striking fashions. Further, as the first three-dimensional manipulation device 16 is located beyond the two-dimensional manipulating device 18, and the second three-dimensional manipulating device 17 is located in front of the two-dimensional manipulating device 18, the three manipulating devices 16, 17 and 18 can be effectively utilized, so that the electronic percussion instrument 1 can be manipulated in a wide range of manners.

Still further, as the electronic percussion instrument 1 of the above described embodiment employs a pad chain setting function, a plurality of strikes onto one pad or one grouped pad zone will cause the generation of tone in the timbre allocated to such a pad or grouped pad zone in response to the first strike, and then cause the generation in the timbre allocated to another pad or grouped pad zone (as designated in the pad chain sequence) in response to the second strike, and so forth. This will permit the use of the timbres allocated to other pads or grouped pad zones in turns in response to the strikes on the same pad or grouped pad zone. This will realize a versatile tonal expressions in response to even a simple striking manner.

A description will be made hereunder about an electronic percussion musical instrument of the second embodiment of the present invention. In explaining the second embodiment in the description and in the corresponding drawing, the like parts are referenced by like numerals and symbols for the sake of understandability, and detailed explanation will be omitted in the following. It should therefore be understood that the matters not described specifically with respect the second embodiment are the same as in the first embodiment. Same will be applicable to further embodiments as may be designed.

FIG. 15 shows a side elevational view illustrating an electronic percussion instrument 1-2 according to a second embodiment of the present invention. This embodiment is similar to the embodiment of FIG. 2*a,* but is a bit different therefrom in that no height difference is provided between three rear pads P1-P3 and three front pads P4-P6 and accordingly the striking face V of the rear pads P1-P3 and the striking face V of the front pads P4-P6 lay in a common inclined plane descending toward the front of the instrument 1-2 at an angle. In addition, the other pads P7-P12 belonging to the first and second three-dimensional manipulating devices 16, 17 are arranged on the same common inclined plane as shown in FIG. 15.

As the six pads P1-P6 of the two-dimensional manipulating device 18 are configured in a common plane, a grouped pad zone comprised of any of the pads P1-P6 assumes a continuous striking face V and the music playing manipulations on the pad zone will be very easy for the player. In the case of FIG. 6*c,* for example, in which all the six pads P1-P6 in the two-dimensional manipulating device are grouped into a single enlarged pad zone G3, the music playing manipulations effectively utilizing the very large manipulating face G3 will be possible. For example, when the two-dimensional manipulating device 18 is used as a drum head, an enlarged area will be very convenient for a music performance simulating a drum performance. This configuration will be also convenient for other music playing styles.

Various Embodiments

While several preferred embodiments have been described and illustrated in detail herein above with reference to the drawings, it should be understood that the illustrated embodiments are just for preferable examples and that the present invention can be practiced with various modifications without departing from the spirit of the present invention. For example, the number and the configuration of the pads are not necessarily limited to the number and the configurations described above, but may be freely designed in other numbers and configurations. The specific shapes of the pads P shown are just for example, and other shapes may be employed. For example, the shape of the three-dimensional pads P may be other than the shown shape with the cylindrically protruded striking surface, such as a shape with a spherically protruded striking face. Although in the electronic percussion instrument 1 of the above described embodiments, the music playing manipulating device 10 comprises twelve pads arrayed in four rows and in three columns, the demarcation of the playing pads should not be limited to that shown, and may be otherwise demarcated, as long as a plurality of pads P are provided.

What is claimed is:

1. An electronic percussion musical instrument comprising:

a music playing manipulation unit including a plurality of playing pads, each constituting a manipulating face zone for playing music by manipulating the face zone, the playing pads being capable of providing an ungrouped pad zone constituted by an individual playing pad among the plurality of playing pads and a grouped pad zone constituted by combining at least two of the playing pads among the plurality of playing pads into a grouped pad zone to work as an integral pad zone;

a storage unit that stores plural timbres of musical tones;

a musical tone allocating unit that allocates the musical tones stored in the storage unit to the ungrouped and/or grouped pad zones in predetermined correspondence;

a music playing manipulation detecting unit that detects a music playing manipulation performed onto any of the pad zones;

a musical tone generating unit that generates a musical tone allocated to the pad zone onto which the music playing manipulation is detected; and a pad chain setting unit that sets for a first pad zone to be manipulated a sequence of designations of at least two different pad zones including a sequence of the first pad zone followed by a second pad zone;

wherein, when the first pad zone is manipulated by an initial music playing manipulation, as detected by the music playing manipulation detecting unit, the musical tone generating unit generates a first musical tone allocated to the first pad zone according to the sequence of designations set by the pad chain setting unit, and wherein, when the first pad zone is manipulated by a subsequent music playing manipulation immediately after the initial music playing manipulation, as detected by the music playing manipulation detecting unit, the musical tone generating unit generates a second musical tone allocated to the second pad zone according to the sequence of designations set by the pad chain setting unit.

2. An electronic percussion musical instrument as claimed in claim 1, wherein a number of musical tones are allocated to a number of pad zones, respectively, and when a plurality of music playing manipulations are performed one after another onto the first pad zone for which the sequence is set, the musical tone generating unit generates the musical tones respectively allocated to the pad zones in an order designated by the sequence set for the first pad zone in response to the plurality of music playing manipulations performed onto the first pad zone.

3. An electronic percussion musical instrument as claimed in claim 1, wherein, when a third pad zone different than the first pad zone is manipulated by a music playing manipulation immediately after the initial music playing manipulation of the first pad zone, as detected by the music playing manipulation detecting unit, the musical tone generating unit generates a musical tone allocated to the third pad zone, and wherein, when the first pad zone is manipulated by a music playing manipulation again immediately after the music playing manipulation of the third pad zone, as detected by the music playing manipulation detecting unit, the musical tone generating unit generates the musical tone allocated to the second pad zone according to the sequence of designations set by the pad chain setting unit.

4. An electronic percussion musical instrument as claimed in claim 1, wherein, when a third pad zone different than the first pad zone is manipulated by a music playing manipulation immediately after the initial music playing manipulation of the first pad zone, as detected by the music playing manipulation detecting unit, the musical tone generating unit generates a musical tone allocated to the third pad zone, and wherein, when the first pad zone is manipulated by a music playing manipulation again immediately after the music playing manipulation of the third pad zone, the musical tone generating unit generates the musical tone allocated to the first pad zone according to a resetting of the sequence of designations set by the pad chain setting unit.

5. An electronic percussion musical instrument as claimed in claim 1, wherein the storage unit stores a first kind of information concerning the allocation of the musical tones to the pad zones and a second kind of information concerning the sequence of designations, the musical tone allocating unit allocates the musical tones to the pad zones based on the first kind of information, and the pad chain setting unit sets the sequence of designations based on the second kind of information.

6. An electronic percussion musical instrument as claimed in claim 1, further comprising:

a playing technique effect imparting unit that imparts an effect of a special playing technique to a musical tone to be generated in response to a music playing manipulation on one of the pad zones; and a playing technique instruction pad zone setting unit that sets a pad zone among the pad zones to work as a playing technique instruction inputting pad zone for inputting an instruction from a player to effect a special playing technique, the playing technique instruction inputting pad zone being determined in association with the pad zone allocated for generating the musical tone to which the effect of the special playing technique is to be imparted, wherein the musical tone generating unit generates a musical tone in response to a manipulation on the pad zone allocated for generating the musical tone with the effect of the special playing technique imparted to the generated musical tone, when the playing technique instruction pad zone is set and an instruction to effect the special playing technique is input by the player.

7. An electronic percussion musical instrument as claimed in claim 6, wherein the pad zone for playing music and the pad zone for inputting the playing technique instruction are both the grouped pad zones.

8. An electronic percussion musical instrument as claimed in claim 6, wherein the playing technique instruction pad zone setting unit sets a single ungrouped pad zone or a grouped pad zone in common for inputting instructions for plural kinds of special playing technique effects.

9. An electronic percussion musical instrument as claimed in claim 7, wherein the playing technique instruction pad zone setting unit sets a single ungrouped pad zone or a grouped pad zone in common for inputting instructions for plural kinds of special playing technique effects.

* * * * *